United States Patent [19]

Suzuki

[11] Patent Number: 5,058,299

[45] Date of Patent: Oct. 22, 1991

[54] ADVERTISING DEVICE

[75] Inventor: Teruo Suzuki, Urayasu, Japan

[73] Assignee: SCS Promotion Company Limited, Chiba, Japan

[21] Appl. No.: 473,670

[22] Filed: Feb. 2, 1990

[30] Foreign Application Priority Data

Feb. 7, 1989 [JP] Japan ..... 1-13271
Oct. 25, 1989 [JP] Japan ..... 1-278290
Dec. 26, 1989 [JP] Japan ..... 1-337497[U]

[51] Int. Cl.[5] ..... G09F 17/00

[52] U.S. Cl. ..... 40/603; 40/590; 40/611; 160/368.1

[58] Field of Search ..... 40/591, 603, 604, 586, 40/589, 590, 611, 617; 160/87, 123, 368.1

[56] References Cited

U.S. PATENT DOCUMENTS 2,391,871 1/1946 Benson ..... 160/368.1
2,527,258 10/1950 Kahn ..... 40/586
2,647,261 8/1953 Rassner ..... 40/586
3,276,512 10/1966 Gallagher ..... 160/368.1
3,461,584 8/1969 Wilson ..... 40/591
3,701,210 10/1972 Smith ..... 40/591
4,369,591 1/1983 Vicino ..... 40/611 X
4,776,121 10/1988 Vicino ..... 40/603 X
4,800,947 1/1989 Loomis .
4,875,302 10/1989 Noffsinger ..... 40/603 X

FOREIGN PATENT DOCUMENTS 0078391 5/1983 European Pat. Off. .
3142829 5/1983 Fed. Rep. of Germany ..... 40/591
3412064 10/1985 Fed. Rep. of Germany .
2572832 5/1986 France .

*Primary Examiner*—Peter R. Brown
*Assistant Examiner*—Brian K. Green
*Attorney, Agent, or Firm*—Nixon & Vanderhye

[57] ABSTRACT

An advertising device for detachably attaching a flexible sheet-like advertising bill. The device comprises a flexible sheet member on which the advertising bill is disposed. An expansible member is disposed in an intermediate portion of the sheet member. The advertising bill is detachably fastened to the sheet member by a fastener comprising a pair of fastening elements, namely a first element and a second element. The first element is secured to the sheet member. The second element is secured to the advertising bill. The first and the second elements cooperate with each other to fasten the advertising bill to the sheet member. The peripheral edge of the sheet member is connected to an advertising place. And an adjuster is provided for adjusting a state of tension of the sheet member.

4 Claims, 22 Drawing Sheets

ADVERTISING DEVICE

BACKGROUND OF THE INVENTION

1. Field of the Invention

The present invention relates to an advertising device for commercial purposes.

2. Description of the Related Art

An advertising device comprises a billboard panel for sticking advertising bills thereon. The bills are stuck on the panel by means of an adhesive agent like a paste for securing them to the panel with certainty. By coating the paste on the panel or the bill, the bill surface is secured with respect to the panel surface.

However, the operation of coating the paste on the panel or the bill and sticking the bill on the panel and the operation of removing the bill from the panel are troublesome and time consuming as well as costly.

On the other hand, it is proposed to secure the bill to the panel by means of a pin or a nail instead of adhesive agent so as to easily stick the bill to the panel and remove it therefrom.

However, when the bill is stuck to the panel by means of pin or nail, openings are easily formed between the bill and the panel so that the bill is apt to be torn by the draft passing through the openings.

SUMMARY OF THE INVENTION

It is therefore an object of the present invention to provide an advertising device which makes it possible to easily stick the advertising bill to the billboard panel and remove the bill from the panel as well as to reliably and securely attach the bill to the panel.

The object of the invention can be achieved by an advertising device for detachably attaching a flexible sheet of advertising bill comprising: a flexible flat support sheet member; a first fastening member arranged on the flat support sheet member; and a second fastening member attached to the bill so as to secure the bill to the flat support sheet member in cooperation with the first fastening member.

Advantages of the above-mentioned advertising device are that it becomes easy to attach and remove an advertising bill to and from a place which is supposed to be very hard to attach the bill thereto such as a wall of a railroad station and a cinema theater etc. which are often required to attach an advertisement thereto, so that the operation time and cost for attaching and removing the bill can be reduced and that the bill can be reliably stuck to the flat support sheet member by the cooperation of the first member and the second member.

Further objects and advantages of the present invention will be apparent from the following description of the preferred embodiments of the invention as illustrated in the accompanying drawings.

DESCRIPTION OF THE PREFERRED EMBODIMENTS

Embodiments of the advertising device in accordance with the present invention are described hereinafter with reference to the drawings.

Figure 1:
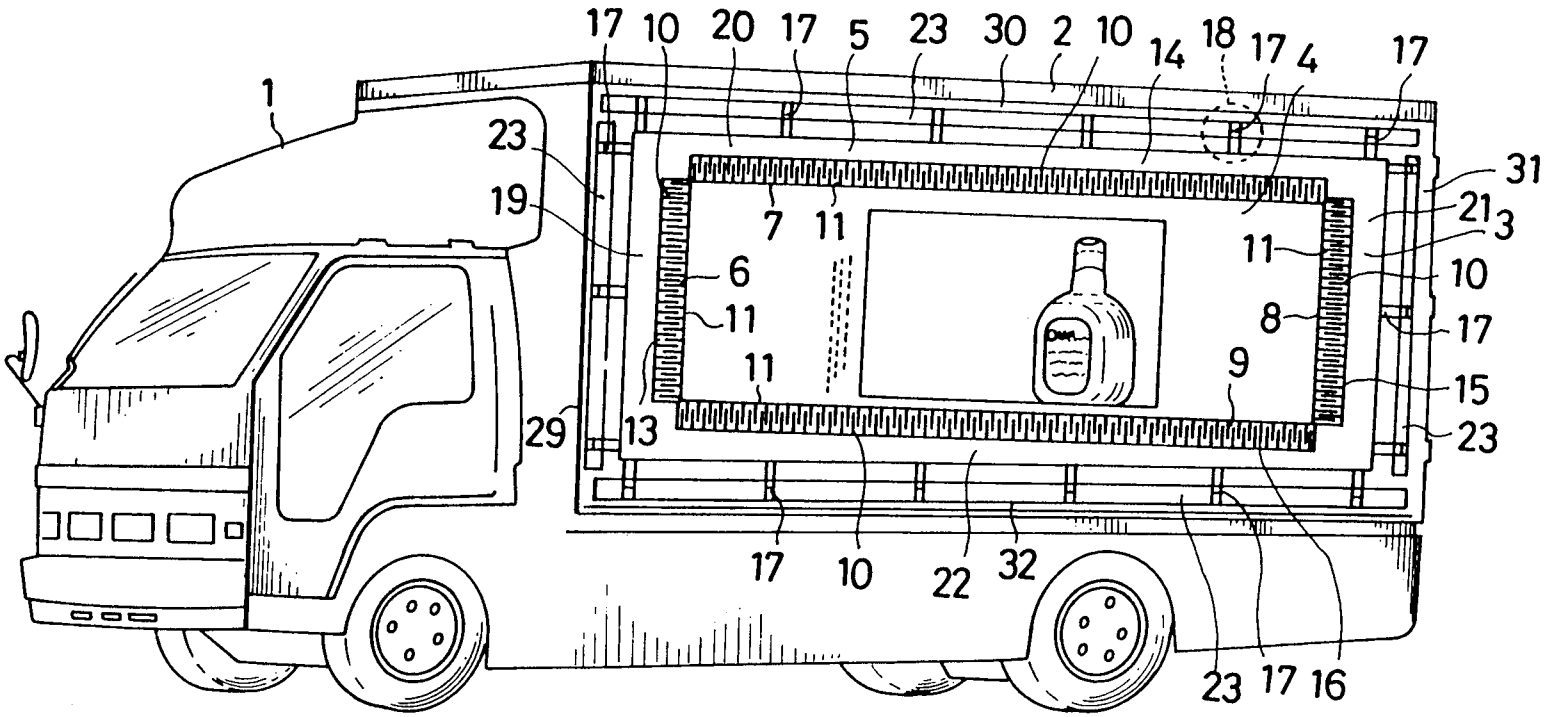
FIG. 1 is an entire outer view of an embodiment of the advertising device in accordance with the present invention.

FIG. 1 illustrates an embodiment of the present invention representing a van type truck provided with an advertising device of the invention.

As illustrated in the drawing, the van type truck 1 is equipped with an advertising device 3 on a side wall 2 thereof. An advertising bill 4 such as an ad-poster is detachably attached to the device 3.

Figure 2:
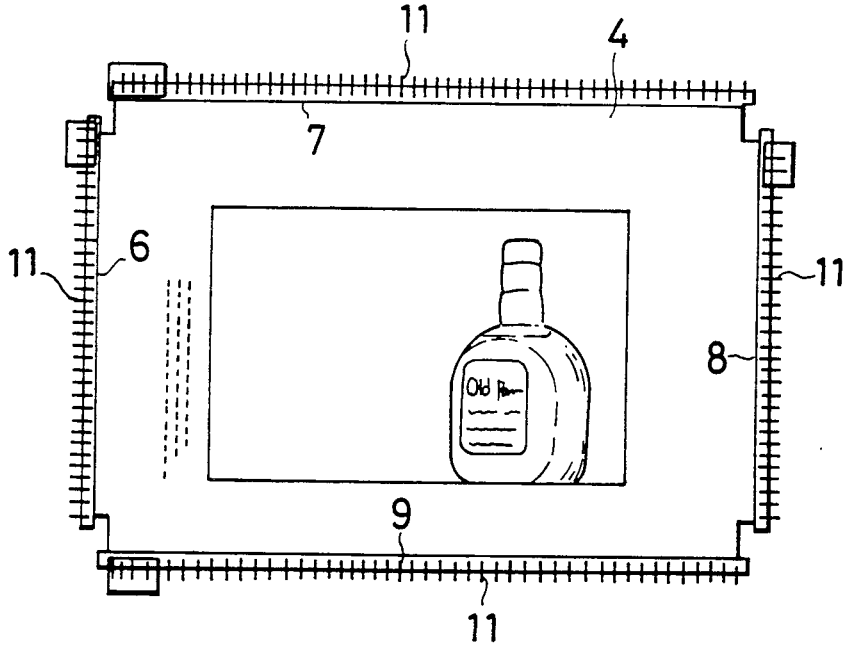
FIG. 2 is a front view of an example of the advertising bill in accordance with the present invention.
Figure 3:
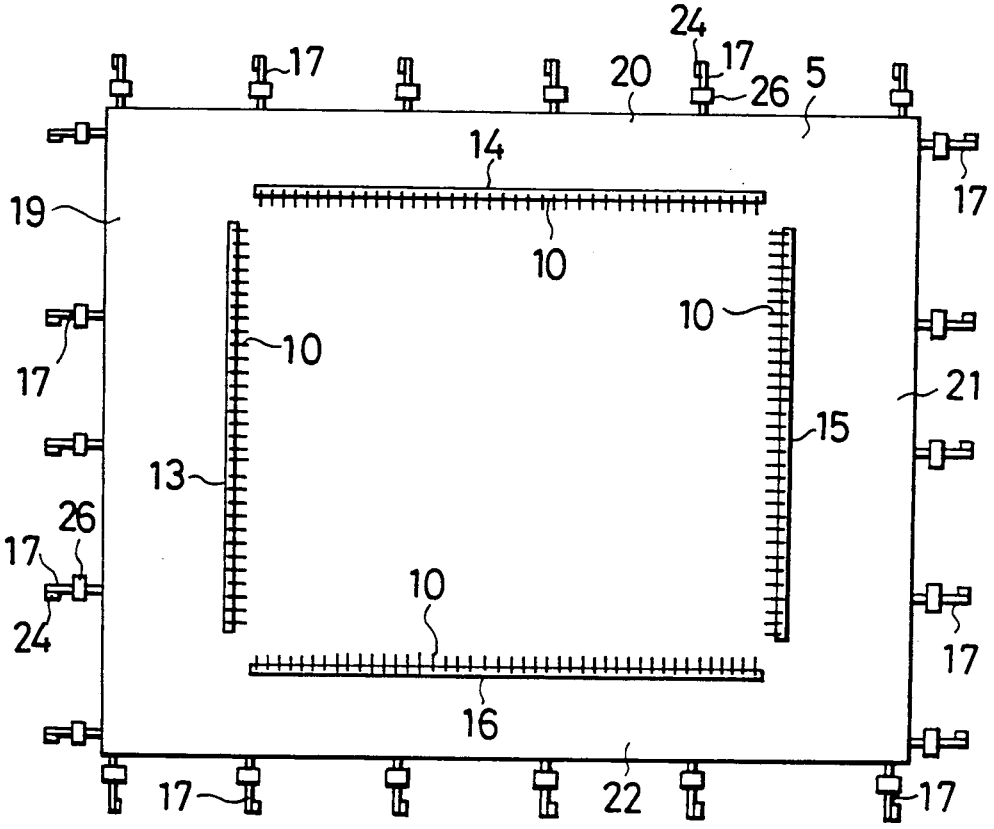
FIG. 3 is a plan view of an example of the flat support sheet member in accordance with the present invention.

As illustrated in FIGS. 1 to 3, the device 3 comprises a sheet member 5 on which four zipper elements 10 are disposed along four sides 13, 14, 15 and 16 (FIG. 3) which form a rectangular corresponding to the shape of the poster 4. The poster 4 is equipped with a zipper element 11 on each of four sides 6, 7, 8 and 9 thereof (FIG. 2). Each element 10 of the sheet member 5 cooperates with the corresponding element 11 of the poster 4 to constitute a fastener means which secures the poster 4 to the sheet member 5. The sheet member 5 is an example of the flexible flat support member mentioned before. The zipper element 10 is an example of the first fastening member mentioned before. Also, the element 11 is an example of the second fastening member which cooperates with the first fastening member to secure the advertising bill to the support sheet member.

The sheet member 5 of the device 3 is provided with a plurality of attaching members 17 for adjustably attaching the member 5 to the side wall 2 of the truck 1.

The elements 11 of the poster 4 may be disposed only on one pair of opposed sides 6 and 8 or on the other pair of opposed sides 7 and 9, instead of disposing all of four sides 6, 7, 8 and 9 as in the case of the above-mentioned example of FIG. 2.

The poster 4 is preferably made from a vinyl film, especially a soft vinyl film. However, the material of the poster 4 is not limited to the film. The poster 4 may be made from any material which is strong enough to have the elements 11 attached on the sides thereof.

The sheet member 5 of the embodiment illustrated in FIGS. 1 and 3 comprises the four zipper elements 10 along the four lines 13, 14, 15 and 16 which form a rectangular in the member 5 corresponding to the shape of the poster 4 so as to fasten the poster 4 to the member 5 means of the elements 10 and 11 in cooperation with each other.

The member 5 may be made from any appropriate flexible material such as a canvas, a vinyl sheet and a rubber sheet, etc.

The member 5 has a plurality of attaching members 17 connected thereto for adjustably attaching the member 5 to the side wall 2 of the truck 1. The attaching members 17 are disposed along and connected to the peripheral sides 19, 20, 21 and 22 of the sheet 5. The number of the members 17 is selected according to the size of the sheet 5 and the state of attaching the sheet 5 to the truck.

Figure 4:
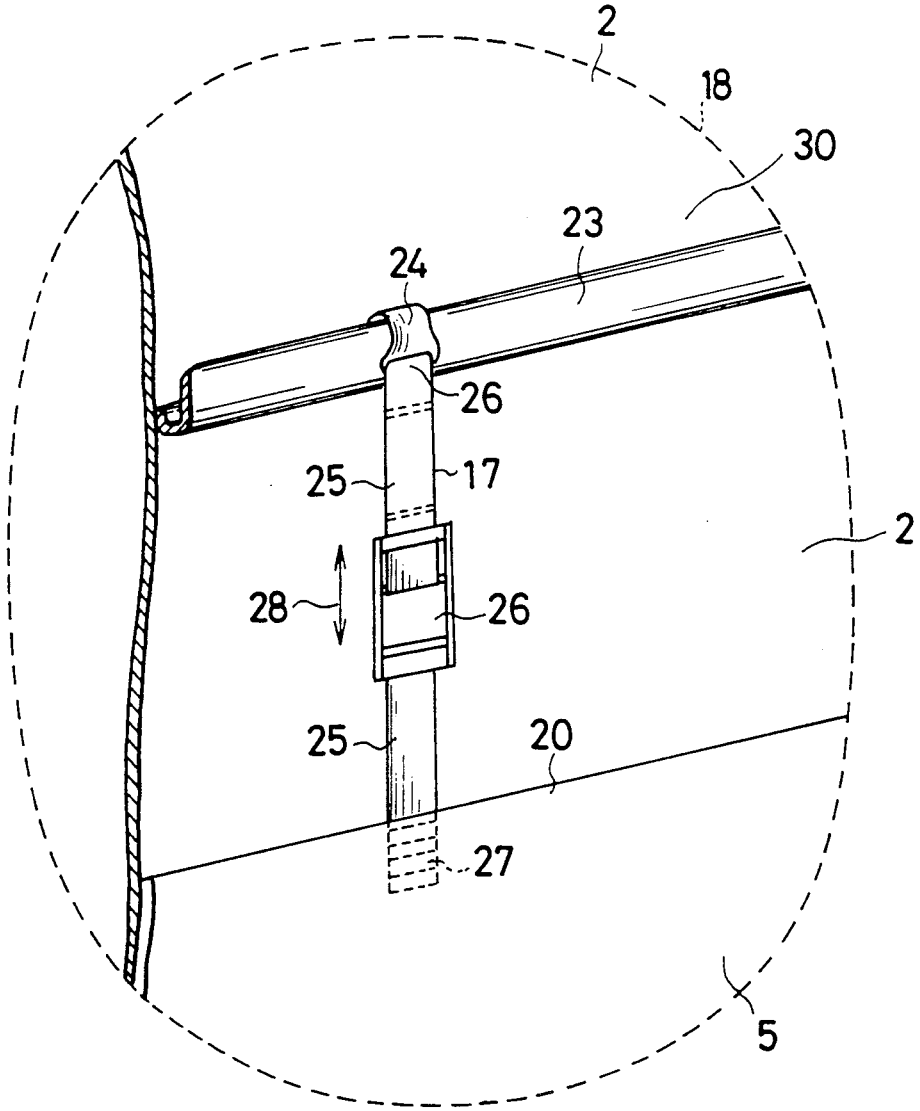
FIG. 4 is a partial enlarged view of the advertising device of the present invention in a state of attaching an advertisement bill.

FIG. 4 illustrates an enlarged view of a part 18 encircled by a dash line in FIG. 1 representing the structure of the attaching member 17 in a state of being attached to the side wall 2 of the truck 1.

As illustrated in FIGS. 1 and 4, a rail member 23 is disposed along each of peripheral edges 29, 30, 31 and 32, respectively, of the side wall 2 of the truck 1. The member 23 has a L-shaped or a J-shaped section, as illustrated in FIG. 4.

The attaching member 17 comprises a belt member 25 secured to the sheet 5 at an end 27 thereof, a hook member 24 secured to the other end 26 of the belt 25 so as to engage the rail 23 and a length adjuster 26 for adjusting the length of the belt 25. The member 17 is used in such a way that in a state wherein the hook 24 catches the rail 23, the length of the belt 25 is adjusted in the direction of an arrow 28 in FIG. 4, whereby the state of tension of the flexible sheet 5 can be adjusted.

The belt 25 is preferably made from cloth, nylon or rubber.

The sheet member 5 and the poster 4 may be fastened together by a generally called magic fastener of velvet type, instead of the abovementioned zipper type fastening means composed of the pair of zipper elements 10 and 11. By using the magic fastener, it becomes easier to attach the poster to the sheet and remove the same from the sheet.

Also, the zipper type fasteners may be used in combination with the magic fasteners.

The zippers are preferably made from metal or resin.

A process for attaching the device 3 mentioned above to the side wall 2 of the truck 1 is described hereinafter.

As illustrated in FIGS. 1 and 4, the rails 23 are secured to the side wall 2 by means of welding, for example, in advance.

First, the hooks 24 of the members 17 secured to the sheet 5 of FIG. 3 are hooked one after another to the rails 23. When all of the members 17 are connected to the rails 23, the length of each belt 25 of the respective member 17 is adjusted in the direction of the arrow 28 so as to even the tension of the sheet 5.

After that, the poster 4 is fastened to the sheet 5 by engaging the elements 11 of the poster 4 with the corresponding element 10 of the sheet 5 so that each corresponding pair of elements 10 and 11 cooperate with each other to secure the poster 4 to the sheet 5. If the poster 4 is being lossened, the slack of the poster 4 can be removed by tightening each of the adjusters 26 to adjust the length of each belt 25 to tension the sheet 5.

When the poster 4 is to be changed, the elements 10 and 11 are disengaged from each other so that the poster 4 can be detached from the sheet 5. After the poster 4 is detached from the sheet 5, another poster is attached to the sheet 5 by the same way as mentioned above.

As mentioned above, in accordance with the embodiment of the advertising device of the present invention, even if the poster 4 is very large, it is easy to attach the poster 4 to the sheet 5 and detach the poster 4 from the sheet 5 since the elements 10 of the flexible sheet 5 can be easily engaged with and disengaged from the corresponding elements 11 of the flexible poster 4.

Another embodiment of the advertising device in accordance with the present invention is described hereinafter with reference to FIGS. 5 to 8.

Figure 5:
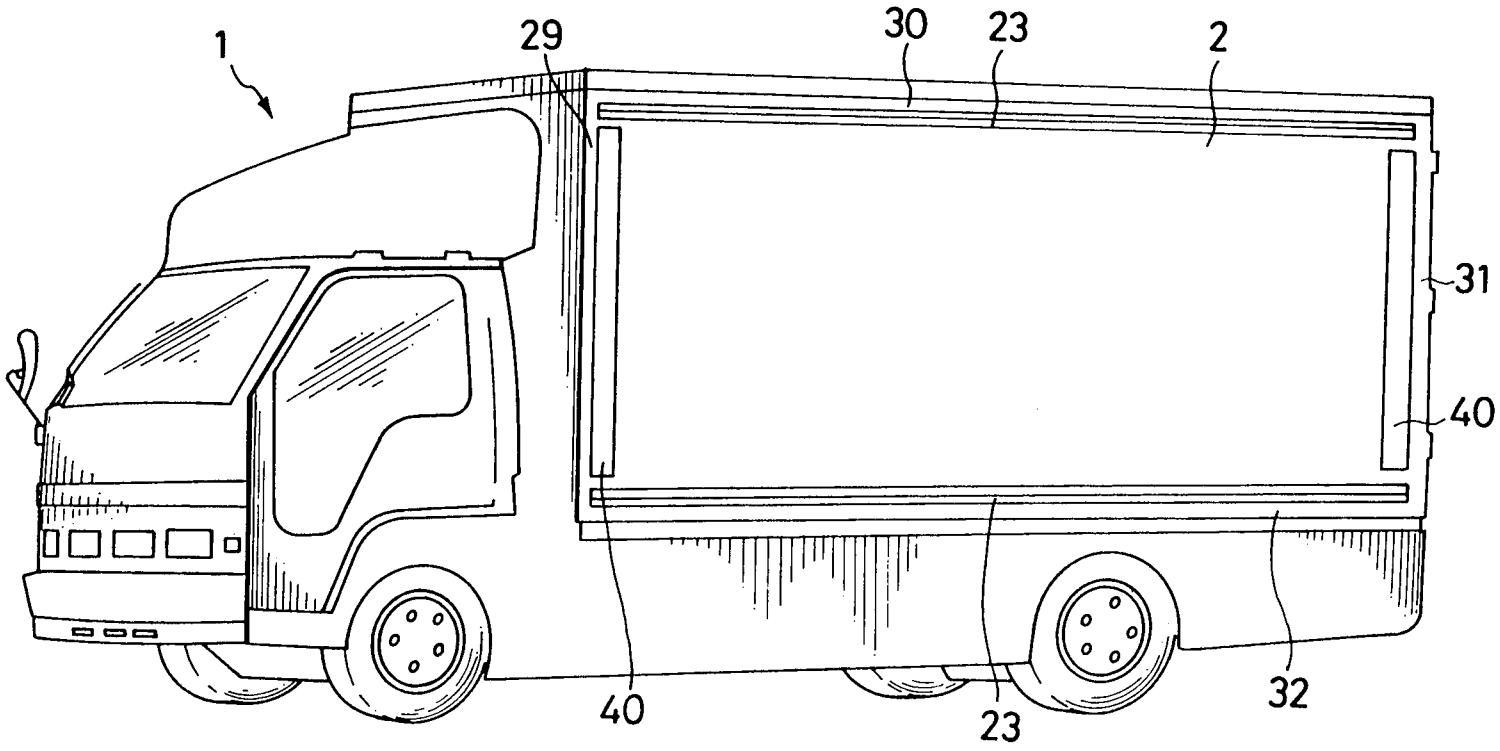
FIG. 5 is an outer view of another embodiment of the advertising device in accordance with the present invention.

As illustrated in FIG. 5, rail members 23 are secured to an upper side edge portion 30 and a lower side edge portion 32 of a side wall 2 of a truck 1, respectively, by means of welding, for example, as the embodiment of FIGS. 1 and 4, mentioned before. To each of the vertical side edge portions 29 and 31 is secured one of a pair of fastening elements 40 of a magic fastener, instead of the rail 23.

Figure 6:
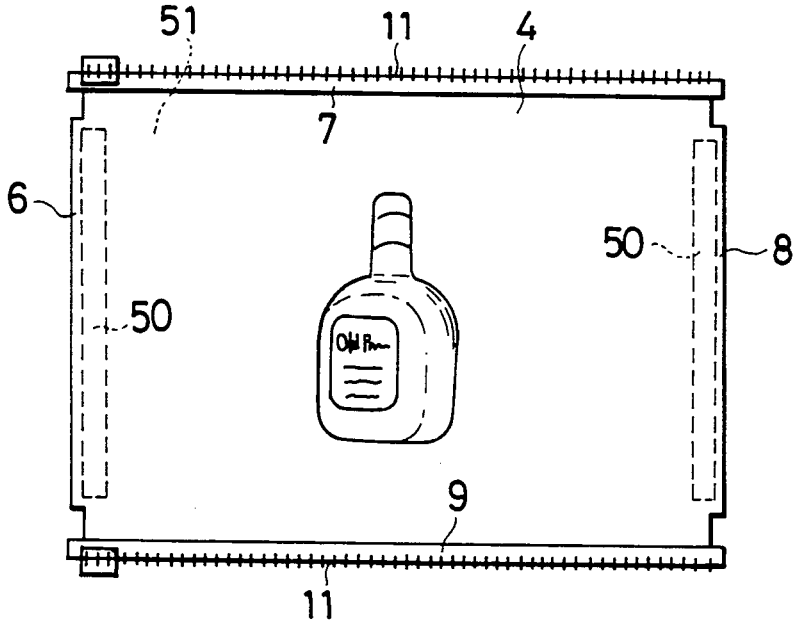
FIG. 6 is a front view of another example of the advertising bill in accordance with the present invention.

Also, as illustrated in FIG. 6, a fastening element 50 which is the the other element of the pair of fastening elements of the magic fastener attached to the sheet 5 is secured to a rear side of the poster 4 along each of the opposed vertical side edge portion 6 and 8 thereof. Also, a zipper element 11 is secured to each of the horizontal side edges 7 and 9, in the same manner as the embodiment of FIG. 1.

The poster 4 is made from the same material as the embodiment of FIG. 1.

Figure 7:
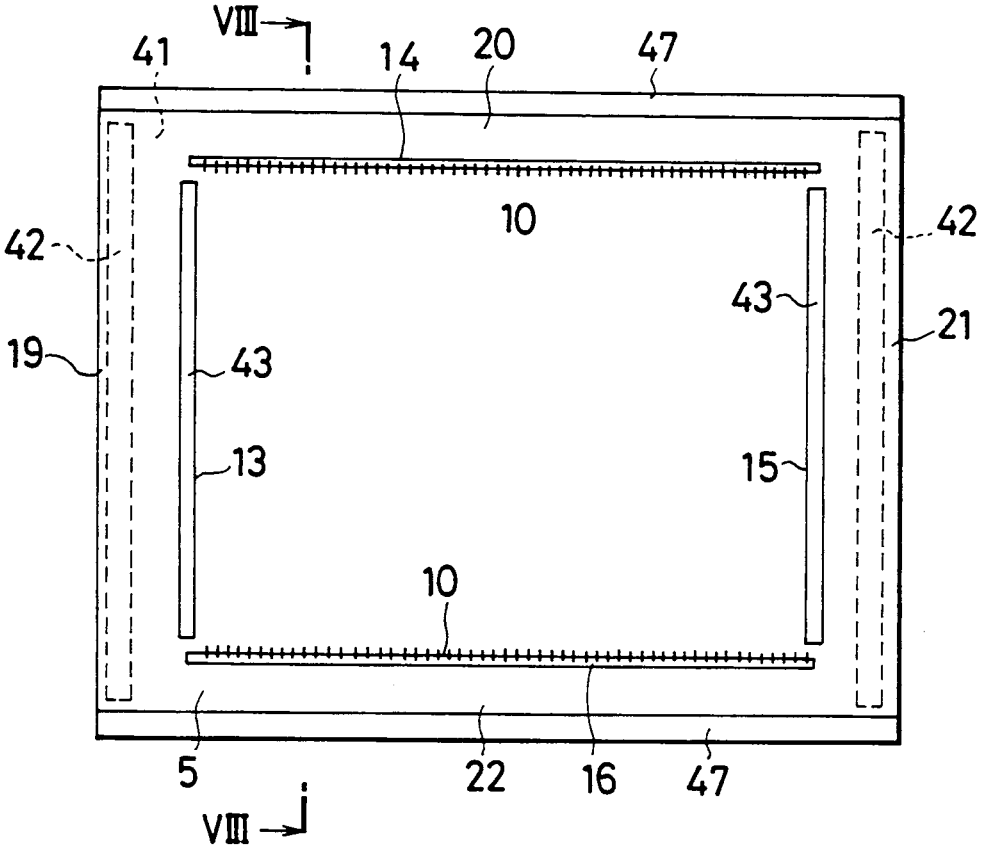
FIG. 7 is a plan view of another exmaple of the flat support sheet member in accordance with the present invention.

As illustrated in FIG. 7, a fastening element 42 is secured to the rear surface 1 of the sheet 5 along each of the opposed vertical side edges 19 and 21. The element 42 is one of a pair of fastening elements of a magic fastener, that is a velvet fastener. The elements 42 cooperate with the corresponding fastening elements 40 attached to the side wall 2 of the truck 1 along the vertical side edges 29 and 31 thereof so that the corresponding elements 40 and 42 engage each other to fasten the sheet 5 to the side wall 2.

Figure 8:
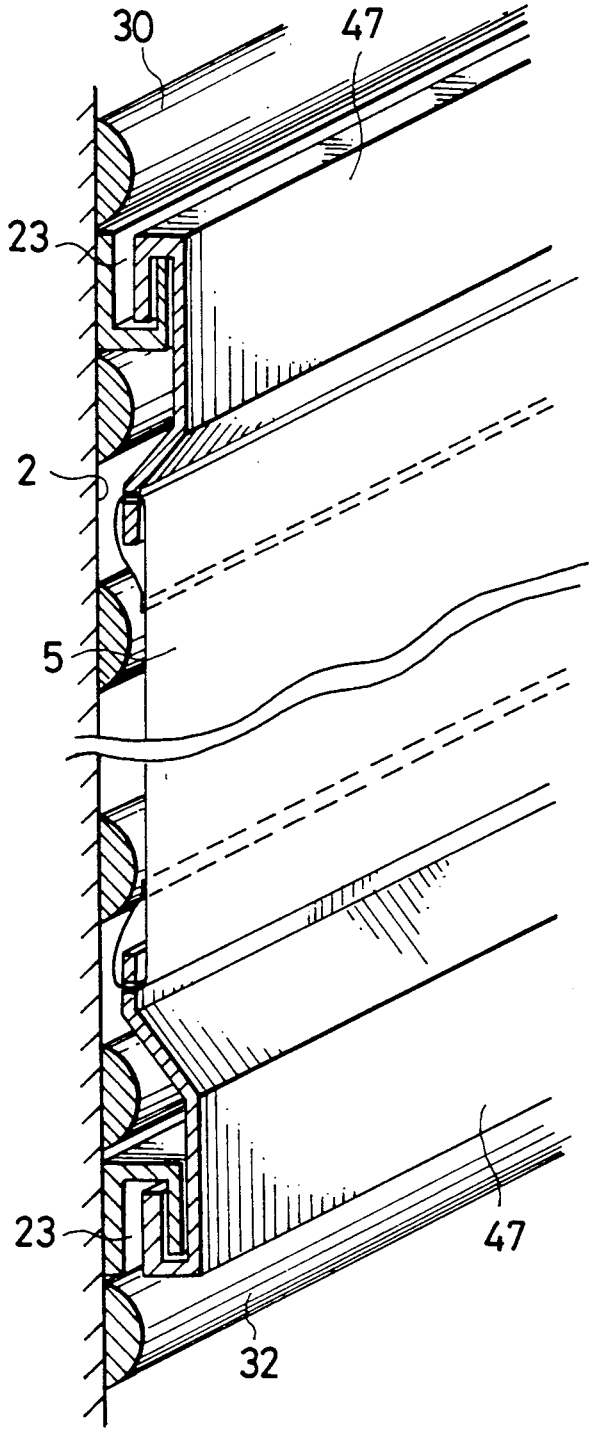
FIG. 8 is an explanatory partial sectional view of the advertising device of the present invention taken along the line VIII—VIII in FIG. 7.

Also, the sheet 5 has a frame member 47 which is secured thereto along each of the upper edge 20 and the lower edge 22 thereof. The frame 47 has an L-shaped or a J-shaped section (see FIG. 8), as the rail 23 which is secured to the side wall 2 of the truck 1 along each of the upper and the lower edges 30 and 32 thereof. The frame 47 is connected to the rail 23 in a manner as illustrated in FIG. 8.

Also, the sheet 5 is provided with fastening elements 43 which are disposed along vertical lines 13 and 15 in the sheet 5, respectively, corresponding to the edges 6 and 8 of the poster 4 along which edges the corresponding fastening elements 50 are arranged. The corresponding elements 43 and 50 cooperate with each other so as to fasten the poster 4 to the sheet 5.

Also, the sheet 5 is provided with zipper elements 10 which are disposed along the upper and the lower horizontal lines 14 and 16 in the sheet 5, respectively, corresponding to the edges 7 and 9 of the poster 4 along which edges the corresponding zipper elements 11 are arranged. The correspoding elements 10 and 11 cooperate with each other so as to fasten the poster 4 to the sheet 5.

The sheet 5 may be made from the same material as the embodiment of FIG. 1, especially it is preferable to use a material having a high elasticity.

The above-mentioned embodiment of the advertising device of the present invention illustrated in FIGS. 5 to 8 is attached to the side wall 2 of the truck 1 in accordance with a process as described below.

As illustrated in FIG. 5, the rails 23 are secured to the side wall 2 by a method of welding, for example, in advance. Also, the elements 40 are secured to the side wall 2 with the use of an adhesive agent, for example, in advance.

First, illustrated in FIG. 8, the upper frame 47 of the sheet 5 is hooked to the upper rail 23 of the side wall 2. After that, the lower frame 47 of the sheet 5 is pulled downwardk, evenly tensioning the sheet 5 to stretch the sheet against the elasticity thereof to the lower rail 23 of the side wall 2 to which rail 23 the lower frame 47 is also hooked.

After that, the elements 11 of the poster 4 of FIG. 6 is connected to the corresponding elements 10 of the sheet 5 of FIG. 7 as well as the elements 50 of the poster 4 is connected to the corresponding elements 43 of the sheet 5 so that the corresponding zipper elements 10 and 11 and the corresponding magic fastener elements 43 and 50 cooperate with each other, respectively, to fasten the poster 4 to the sheet 5.

In this state, the sheet 5 is evenly tensioned by the elasticity thereof, which in turn imposes a strong tension to the poster 4 fastened thereto. As a result, slack generated in the poster 4 is removed by the strong tension applied thereto.

In other words, the sheet 5 functions as an adjuster means for automatically adjusting the state of tension of the sheet 5 and the poster 4 attached to the sheet 5 due to the elasticity of the sheet 5 itself.

Figure 9:
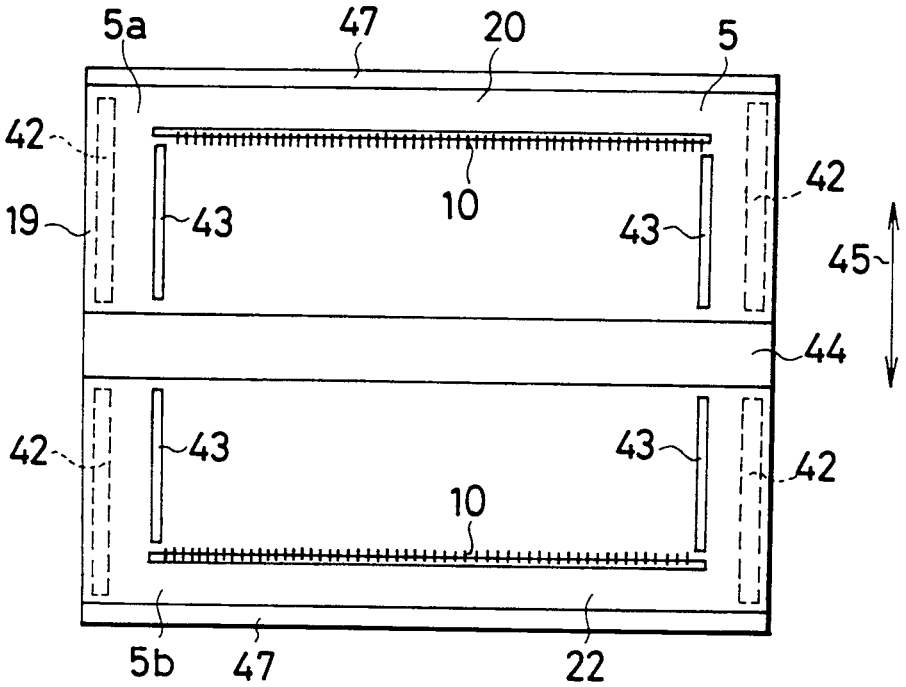
FIG. 9 is a plan view of a variant of the support sheet member of the present invention.

FIG. 9 illustrates a variant of the sheet 5 of the above-mentioned embodiment of FIG. 7. In this variant structure, the sheet 5 is divided to two parts, i.e., an upper half part 5*a* and a lower half part 5*b*. The two parts 5*a* and 5*b* are connected together via an elastic member 44 made from a rubber sheet or a woven rubber belt. Due to this member 44, the elasticity thereof is added to the sheet 5 in the vertical direction 45 in FIG. 9 so that the sheet 5 becomes more elastic, which makes it possible to more easily adjust the state of tension of the sheet 5 and more easily attach the sheet 5 to the truck 1 and maintain it being firmly attached to the truck.

Figure 10:
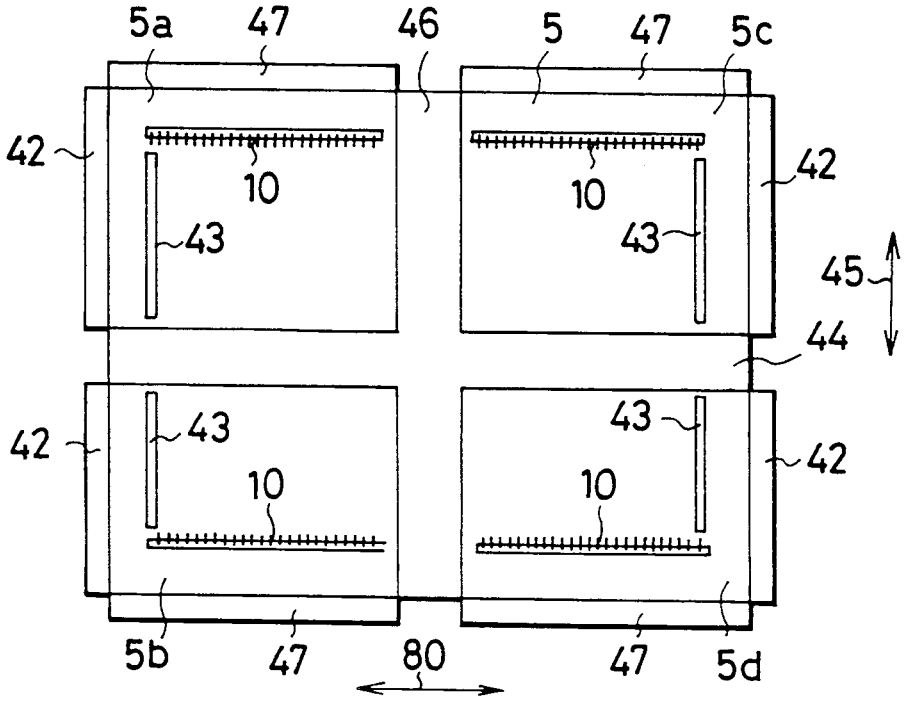
FIG. 10 is a plan view of another variant of the support sheet member of the present invention.

FIG. 10 illustrates another variant of the sheet 5 of FIG. 7. In this variant structure, the sheet 5 is further divided vertically in addition to being divided horizontally so that the sheet 5 comprises four parts 5*a*, 5*b*, 5*c* and 5*d*. A horizontal elastic member 44 and a vertical elastic member 46 are interposed between the parts 5*a*, 5*b*, 5*c* and 5*d*, as illustrated in FIG. 10. The elastic members 44 and 46 are made from the same material as the member 44 of FIG. 9. In accordance with this arrangement of the members 44 and 46, the sheet 5 becomes more elastic in the horizontal direction of the arrow 80 as well as in the vertical direction of the arrow 45 in FIG. 10. As a result, the sheet 5 can be more easily adjusted vertically and horizontally.

Figure 11:
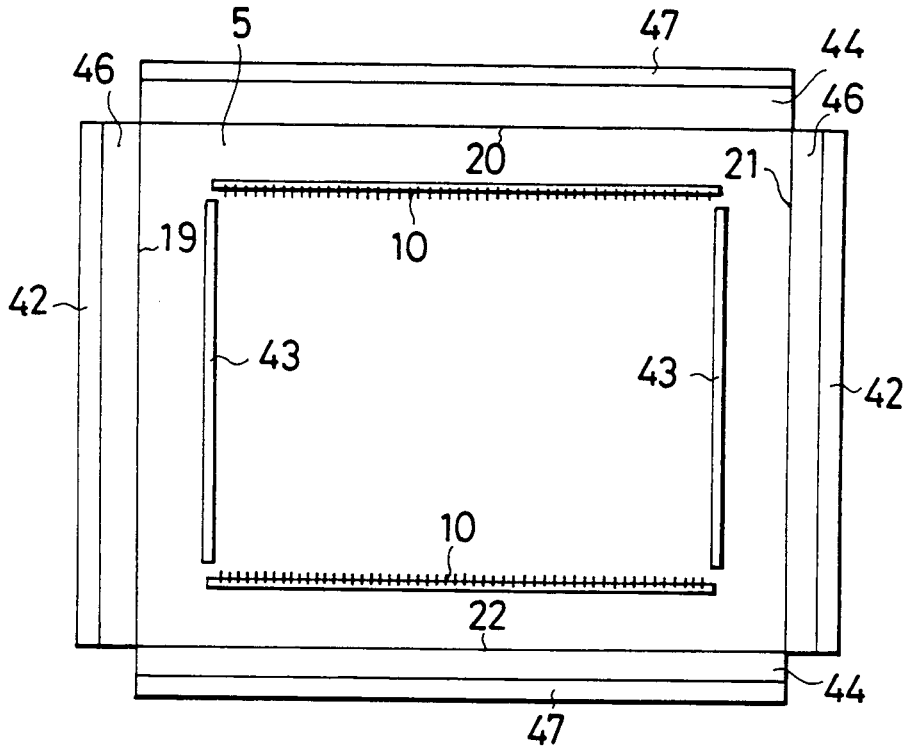
FIG. 11 is a plan view of still another variant of the support sheet member of the present invention.

FIG. 11 illustrates still another variant o the sheet 5 of FIG. 7. In this variant structure, the horizontal elastic members 44 and the vertical elastic members 46 are disposed along the peripheral four edges 19, 20, 21 and 22 of the sheet 5 instead of the structure of FIG. 10 wherein the sheet 5 is divided to four parts 5*a*, 5*b*, 5*c* and 5*d* between which the members 44 and 46 are interposed. More precisely, the member 46 is disposed between the member 42 and each of the right and the left edges 19 and 21. Also, the member 44 is disposed between the frame 47 and each of the upper and the lower edges 20 and 22. In accordance with this structure of FIG. 11, the elasticity of the sheet 5 is also heightened in both of the vertical direction and the horizontal direction.

Figure 12:
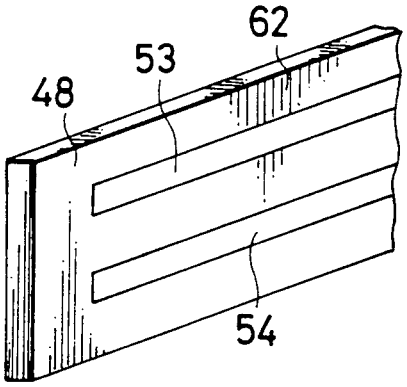
FIG. 12 is an explanatory view representing a part of a frame member of the advertising device in accordance with the present invention.
Figure 13:
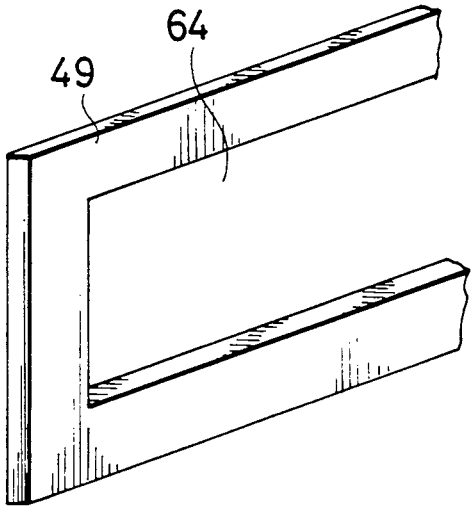
FIG. 13 is an explanatory view representing a part of a variant of the frame member of the advertising device in accordance with the present invention.

FIGS. 12 and 13 illustrate variants of the frame 47 of FIG. 8 which is hooked to the rail 23 of the side wall 2 of the truck 1 of FIG. 5.

Figure 14:
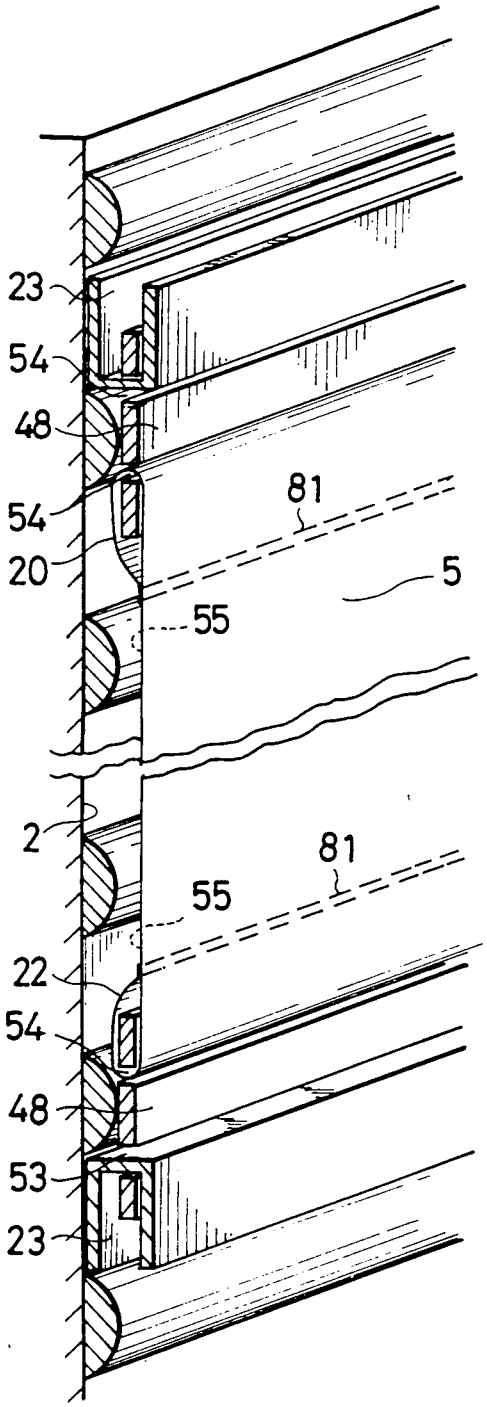
FIG. 14 is an explanatory partial sectional view of a variant of the advertising device of the present invention taken along the line VIII—VIII in FIG. 7.

The frame 48 of FIG. 12 is attached to the side wall 2 of the truck 1 and the sheet 5 in such a manner as illustrated in FIG. 14.

The frame 48 has two slits 53 and 54, as illustrated in FIG. 12. An upper edge 20 of the sheet 5 is inserted into the slit 54, as illustrated in FIG. 14. The edge 20 which passes through the slit 54 is folded back to the rear surface of the sheet 5 and secured thereto by a method of stitching, for example, as indicated by numeral 81. The frame 48 to which the sheet 5 is attached is hooked to the rail 23 by inserting the rail 23 into the slit 53 of the frame 48, as illustrated in FIG. 14.

Figure 15:
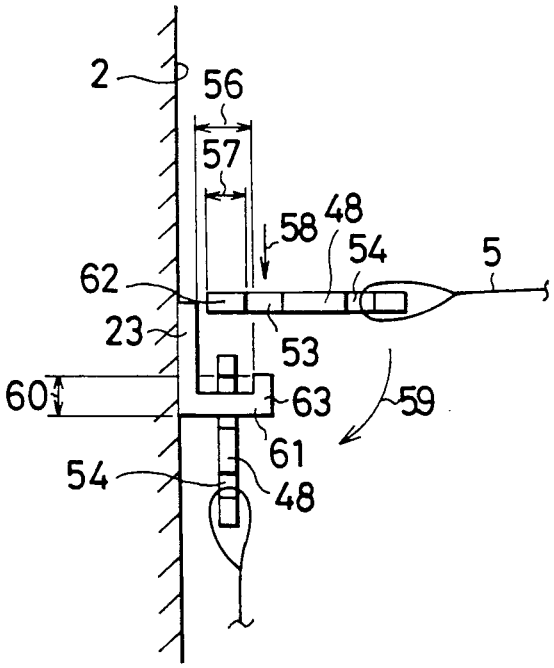
FIG. 15 is an explanatory view of the frame member of another variant of the advertising device in accordance with the present invention for explaining the process for attaching the frame member.

The frame 48 is hooked to the rail 23 in a manner as illustrated in FIG. 15. That is, first, the frame 48 is held horizontal at a position where the slit 53 faces to a front rim 63 of the rail 23 so that the rim 63 can be inserted into the slit 53. Then the frame 48 is moved downward to insert the rim 63 of the rail 23 into the slit 53 of the frame 48, as indicated by an arrow 58. After that, the frame 48 to which the sheet 5 is secured is rotated as indicated by an arrow 59 so that the frame 48 is hooked to the rail 23. It is necessary to appropriately select the dimension of the width 56 of the groove bottom 61 of the rail 23, the width 57 of the leading edge 62 of the frame 48 and the height 60 of the front rim 63 of the rail 23, so that the above-mentioned insert motion of the frame 48 can be carried out.

FIG. 13 illustrates a frame member 49 having a wide opening 64 which has an opening area larger than the sum of the slits 53 and 54 of the frame 48 of FIG. 12. Therefore, the frame 49 can be easily hooked to the rail 23 without manipulating the frame 49 as illustrated in FIG. 15 as is necessary to the frame 48 of FIG. 12.

Figure 16:
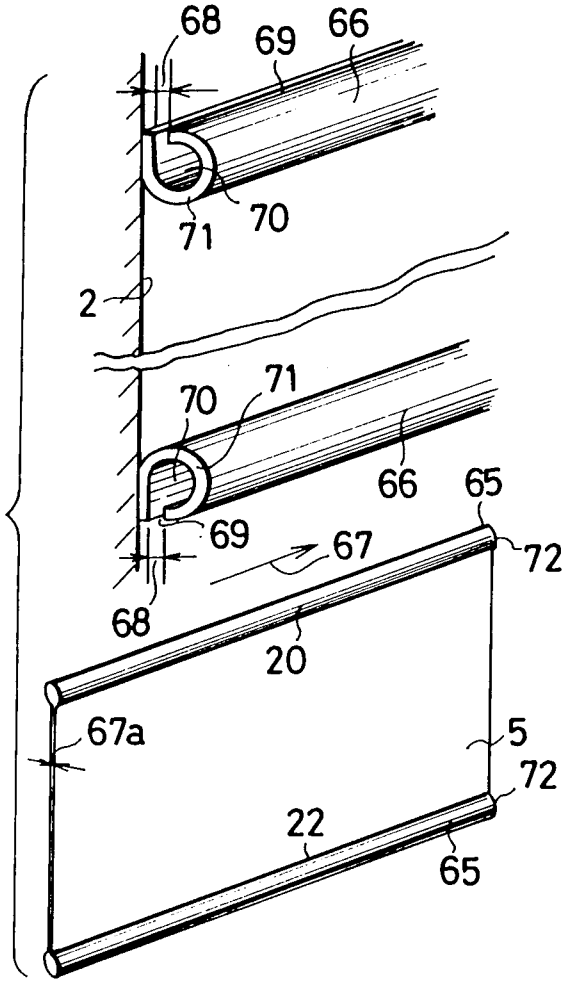
FIG. 16 is an explanatory view of the frame member of still another variant of the advertising device in accordance with the present invention for explaining the process for attaching the frame member.

FIG. 16 illustrates another example of the rail member 23 of the embodiment mentioned above. The structure of FIG. 16 comprises a rail 66 having a circular sectional shape. The rail 66 has a slit 69 the width 68 of which is larger than the thickness 67*a* of the sheet 5.

On the other hand, a frame 65 which can be inserted into the inner space of the rail 66 is secured to each of the upper and the lower edges 20 and 22 of the sheet 5, respectively.

The sheet 5 having the structure mentioned above is attached to the side wall 2 in a manner described below.

The frame 65 is inserted into the inner space 70 of the rail 66 from an end 72 thereof through an opening end 71 of the rail 66. The frame 65 is moved into the inner space 70 of the rail 66 as indicated by an arrow 67 in a manner that the sheet 5 is in the slit 69 of the rail 66 sliding therein as indicated by the arrow.

Figure 17:
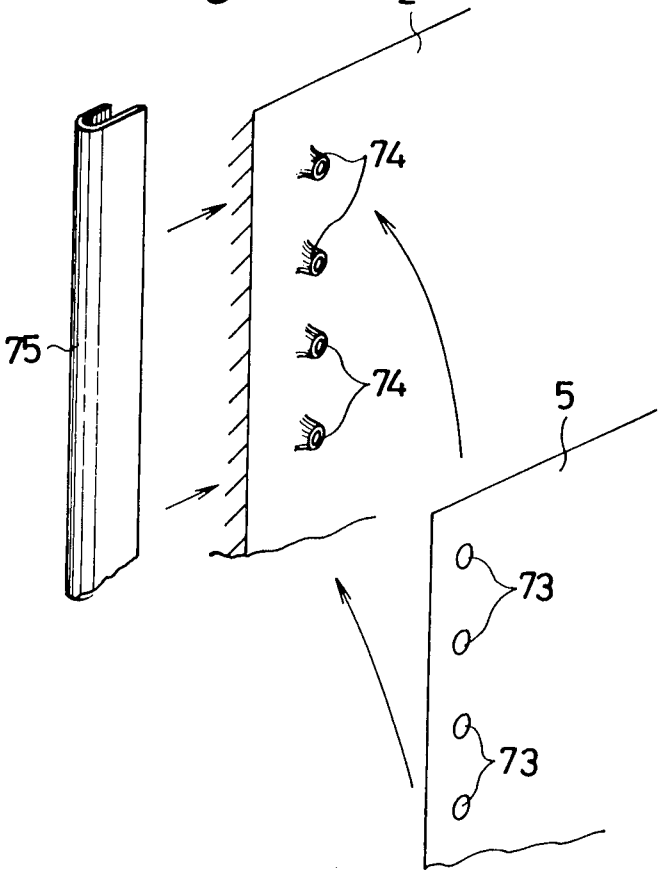
FIG. 17 is an explanatory view of another example of the securing member of the advertising device in accordance with the present invention.

FIG. 17 illustrates another example of fastening menas for securing the sheet 5 to the side wall 2. This exmaple comprises a snap fastener means which may be substituted for the magic fastener means used in the above-mentioned embodiments. The snap fastener comprises male elements 74 formed on the side wall 2 and female elements 73 formed in the sheet 5. The elements 73 and 74 are connected together to cooperate with each other to fasten the sheet 5 to the wall 2.

It is to be noted that when the snap fastener means is used, it is desirable to arrange a cover 75 on the snap fastener means, as illustrated in FIG. 17, in order to baffle the draft passing through the fastener.

A further preferred embodiment of the present invention is described hereinafter with reference to the drawings.

Figure 18:
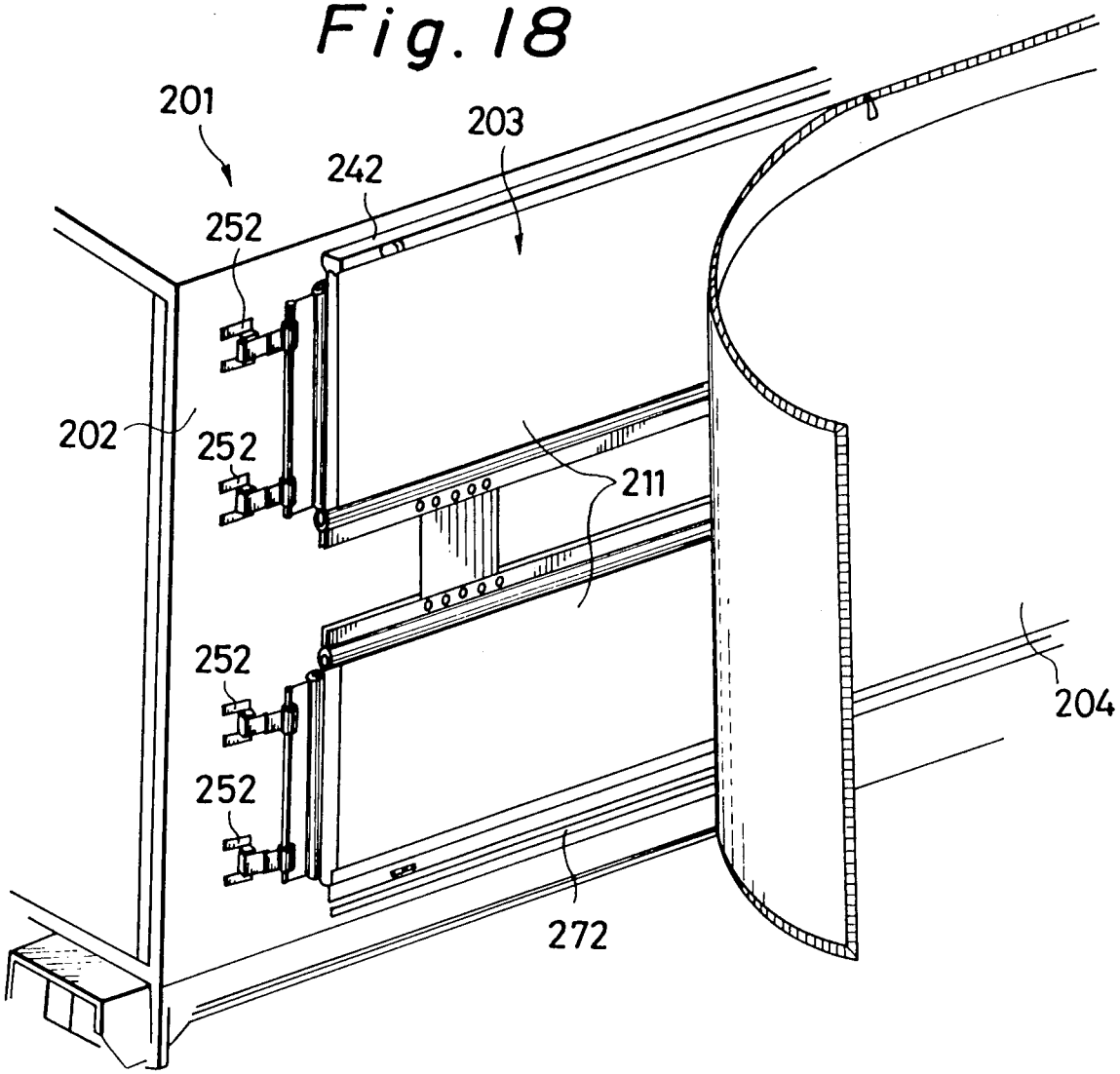
FIG. 18 is a perspective view of another embodiment of the advertising device in accordance with the present invention.

FIG. 18 illustrates the embodiment which is applied to a van type truck 201 comprising a side wall 202 which constitutes a room for carrying loads. An advertising device 203 for detachably sticking a bill or poster 204 is attached to the wall 202.

The poster 204 is fastened to a sheet member 211 which is secured to the wall 202 of the truck 201. This embodiment is especially preferable when it is applied to the van type truck.

As illustrated in FIGS. 18 to 22, the device 203 comprises the sheet 211 as a flexible flat member for supporting an advertising bill (poster 204). The poster 204 has four peripheral edges 206, 207, 208 and 209 constituting a rectangle (FIG. 23). The sheet 211 comprises zipper elements 216 disposed along an upper and a lower horizontal edge lines 212 thereof corresponding to the edges 206 and 207 of the poster 204, respectively. The sheet 211 also comprises fastening elements 218 of a generally called magic fastener or velvet fastener which elements 208 are disposed along a right and a left vertical edge line portions 214 corresponding to the edges 208 and 209 of the poster 204.

Also, as illustrated in FIG. 23, the poster 204 comprises zipper elements 217 secured thereto along the upper and the lower edges 206 and 207 thereof. The element 216 of the sheet 211 and the corresponding element 217 of the poster 204 cooperate with each other to constitute one zipper type fastening means. The poster 204 also comprises fastening elements 219 of the magic fastener corresponding to the fastening elements 218 of the sheet 211. Two elements 219 are arranged along each of the edges 208 and 209 of the poster 204. Note that one fastening element 219 may be arranged along the entire length of each edge instead of the arrangement wherein two separated elements 219 are arranged along each edge as illustrated in FIG. 23.

The sheet 211 is attached to the wall 202 of the truck 201 through attaching means 241 and 251 and adjuster means 271 and 291, respectively.

It is to be noted that the layout and the combination of the zipper means and the magic fastener means are not limited to those descrived above. Either means may be disposed along the edges of the poster 204. Also, the fastening means may be arranged only along one pair of opposed edges, i.e., the horizontal upper and the lower edges or the vertical right and the left edges.

The poster 204 may be made from a canvas, a cloth or a vinyl film especially a soft film. However, the material to form the poster 204 is not limied to those mentioned above. It is possible to use any material for forming the poster 204 which material is strong enough to secure the elements 217 and/or 219 thereto. Also, the zipper element is preferably made from metal or resin.

Figure 19:
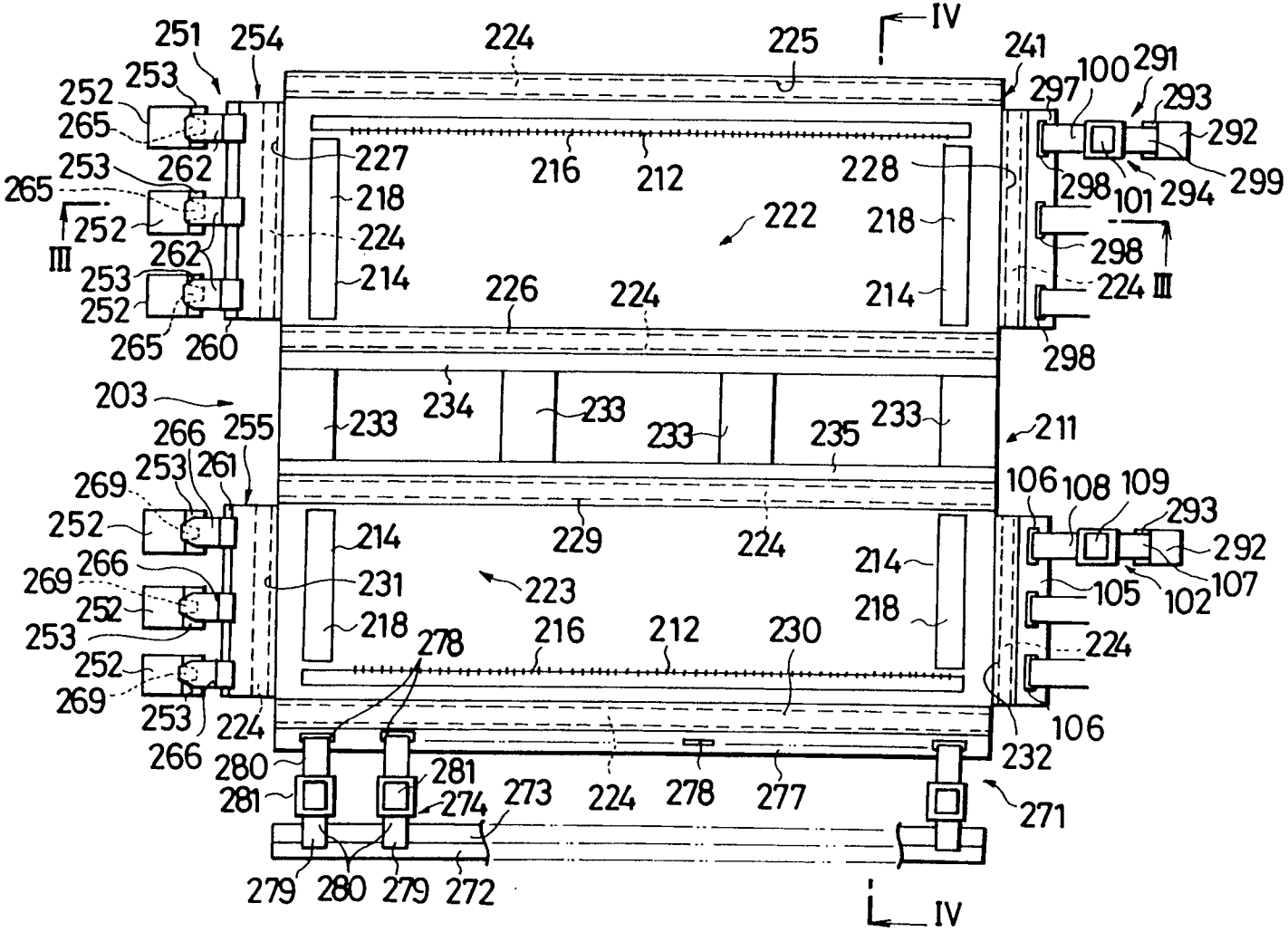
FIG. 19 is a plan view of the sheet member of the advertising device in accordance with the present invention.

As illustrated in FIG. 19, the sheet 211 is divided to two parts, namely an upper sheet 222 and a lower sheet 223. The upper and the lower sheets 222 and 223 are connected together through a plurality of expansible members 233 made from rubber, for example. The member 233 may be made from any elastic material having a predetermined elasticity and not limited to rubber.

A thick rope 224 made from a flexible fablic material such as nylon is arranged along each of the four peripheral edges of the respective upper and the lower sheet 222 and 223 in such a way that the sheet edge is wound to enclose the rope 224 therein to form thickened edges 225, 226, 227 and 228, respectively, along the upper edge, the lower edge, the left edge and the right edge of the upper sheet 222 and also to form thickened edges 229, 230, 231 and 232, respectively, along the upper edge, the lower edge, the left edge and the right edge of the lower sheet 223.

Figure 22:
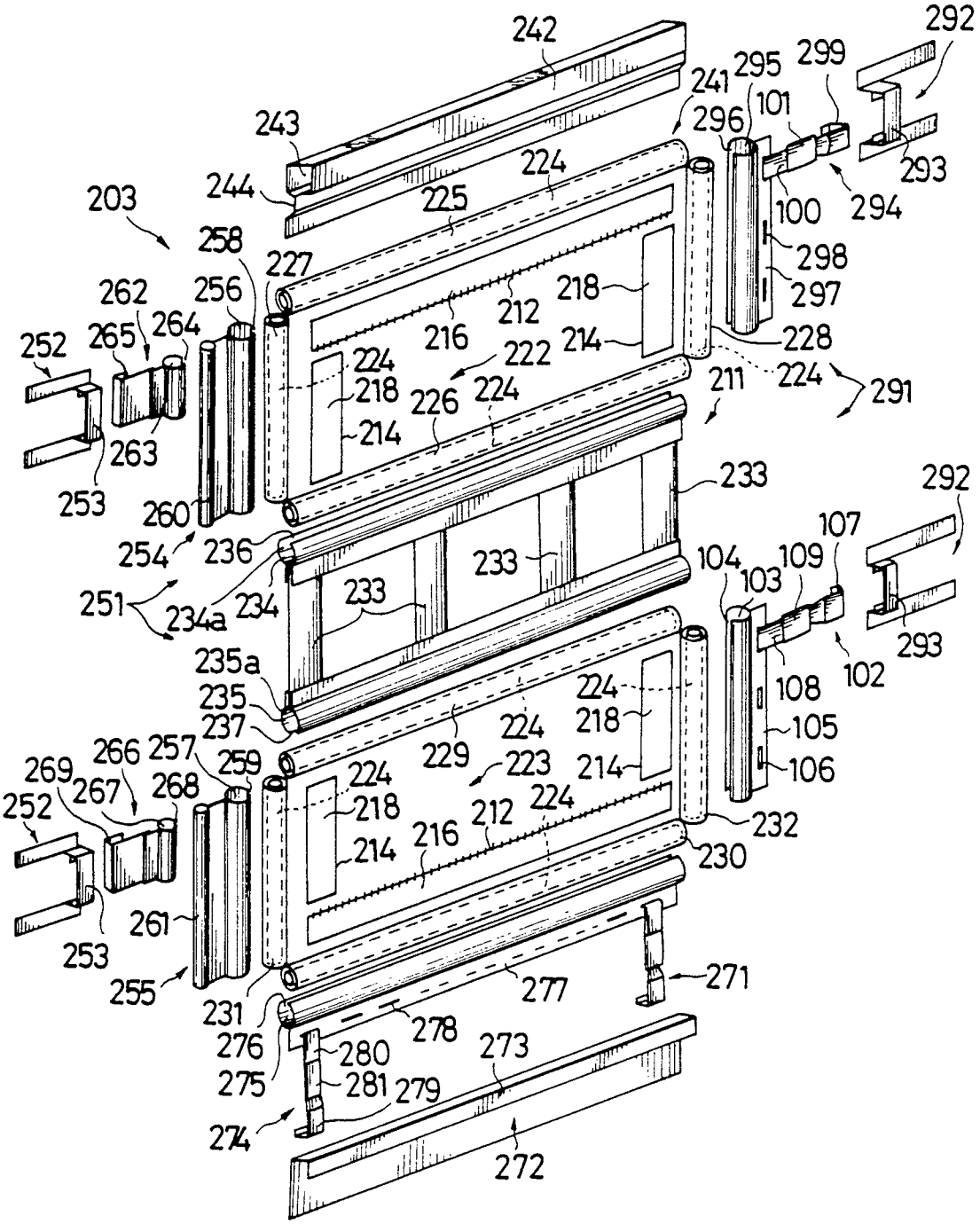
FIG. 22 is an exploded perspective view of an embodiment of the advertising device in accordance with the present invention representing a structure of the sheet member thereof, an attaching structure thereof and an adjusting structure thereof.
Figure 23:
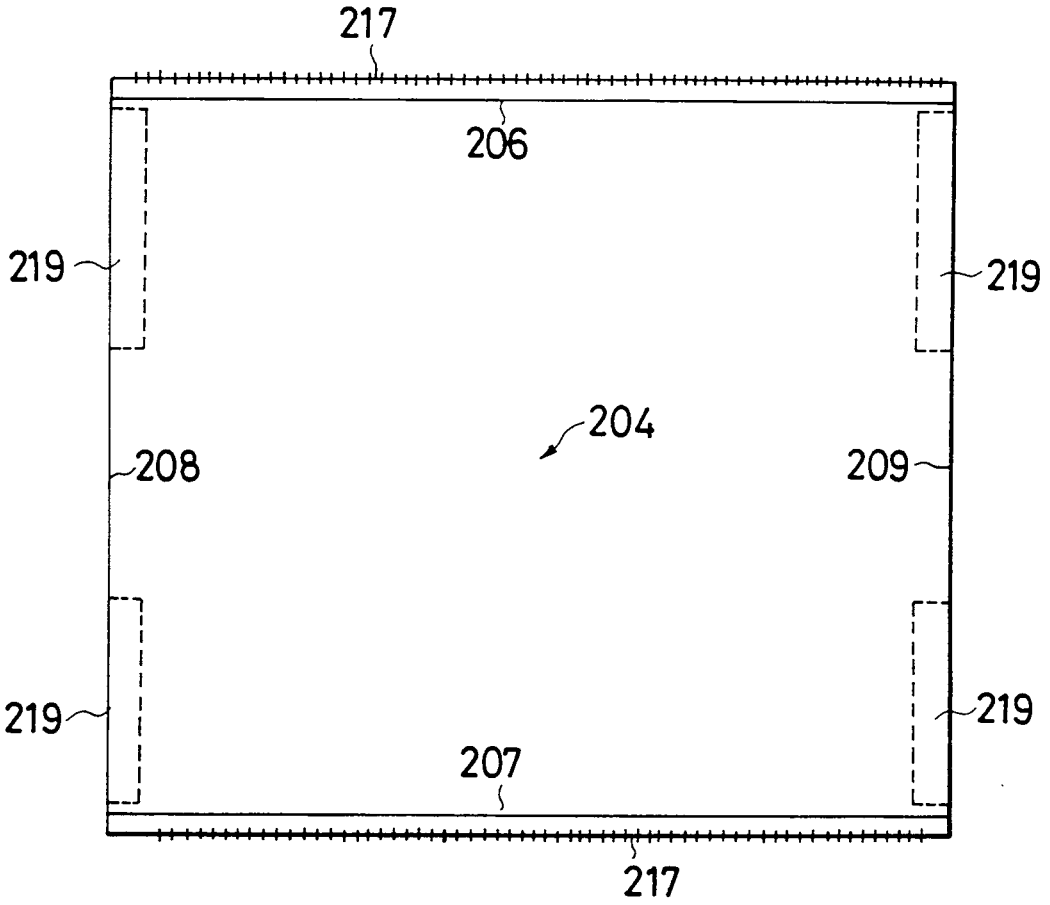
FIG. 23 is a plan view of an example of the sheet of advertising bill in accordance with the present invention.

As can be seen from FIG. 22, an upper end of each expansible member 233 is connected to an upper holder member 234 which has an inner space 234a for receiving the thickened edge 226 of the upper sheet 222 and a slit 236 having an openign width corresponding to the thickness of the sheet 222 for inserting the sheet 222. Also, a lower end of each expansible member 233 is connected to a lower holder member 235 which has an inner space 235a for receiving the thickened edge 229 of the lower sheet 223 and a slit 237 having an opening width corresponding to the thickness of the sheet 223 for inserting the sheet thereinto.

The thickened edge 226 of the upper sheet 222 is inserted into the inner space 234a of the holder 234 and the thickened edge 229 of the lower sheet 223 is inserted into the inner space 235a of the holder 235 so that the upper sheet 222 and the lower sheet 223 are interconnected together through the holders 234 and 235 and the expansible members 233.

The sheets 222 and 223 may be made from any flexible material such as a canvas, a vinyl sheet or a rubber sheet.

The reason for arranging the flexible material as the rope 224 is that by using the flexible rope 224 to form the thickened edges of the sheets 222 and 223, it becomes possible to fold the sheets when not in use for the sake of convenience for storage or at the time of carrying the sheet. Hoever, the thickened edge may be formed by a rigid material.

As illustrated in FIGS. 19 to 22, the sheet 211 is provided with the attaching means 241 and 251 along the upper edge and the left edge thereof and the adjusting means 271 and 291 for adjusting the state of attaching the sheet along the lower edge and the right edge thereof.

Figure 21:
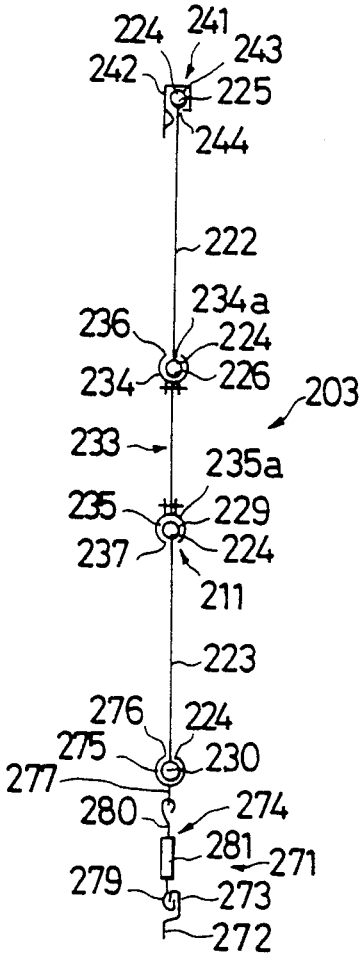
FIG. 21 is a sectional view of an assembled advertising device of the present invention taken along the line IV—IV in FIG. 19.

As illustrated in FIGS. 18, 21 and 22, the upper attaching means 241 comprises an upper support member 242 which is secured to an upper portion of the wall 202 of the truck 201.

The support member 242 has a slit 244 opening downward and having a width corresponding to the thickness of the sheet 222 and an inner space 243 for receiving the thickened edge 225 of the sheet 222.

In accordance with the structure of the means 241 mentioned above, as illustrated in FIG. 26, the edge 225 of the sheet 222 is inserted into the space 243 of the support member 242 so that the upper sheet 222 is connected to the member 242.

The member 242 may be constituted from a plurality of segments disposed on a line along the edge 225 of the sheet 222 to substantially form a continuous longitudinal structure instead of being made from one integral structure as illustrated in FIG. 22.

The attaching means 251 which is disposed on the left side of the sheet 211 comprises, as illustrated in FIG. 19, a plurality of support pieces 252 which are secured to the wall 202 of the truck 201, an upper attachment member 254, a lower attachment member 255 and a plurality of hooks 262, 266.

Figure 20:
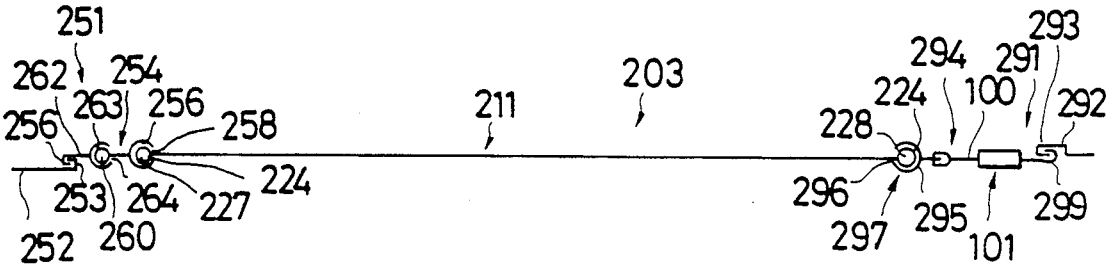
FIG. 20 is a sectional view of an assembled advertising device of the present invention taken along the line III—III in FIG. 19.

Each support piece 252 comprises a receiving mouth 253 which opens leftward in FIGS. 19 and 20.

The upper attachment member 254 comprises a sleeve member which has a slit 258 on the right thereof in FIG. 20 having a width corresponding to the sheet thickness for inserting the sheet therein and which sleeve has an inner space 256 for receiving the thickened edge 227 of the sheet 222. The attachment member 254 also comprises a thickened edge member 260 which is connected to the sleeve. The lower attachment member 255 has a structure similar to that of the member 254 and comprises a sleeve member which has a slit 259 and an inner space 257 and a thickened edge 261 connecting to the sleeve.

Each of the hook members 262 and 266 comprises a short sleeve which has a slit 264, 268 openign rightward in FIG. 20 and an inner space 263, 267 and a hook piece 265, 269 for catching the mouth 253 of the piece 252. The hook piece 265, 269 is connected to the sleeve having the inner space 263, 267. The space 263, 267 receives the edge 260, 261 of the attachment member 254, 255.

Figure 27:
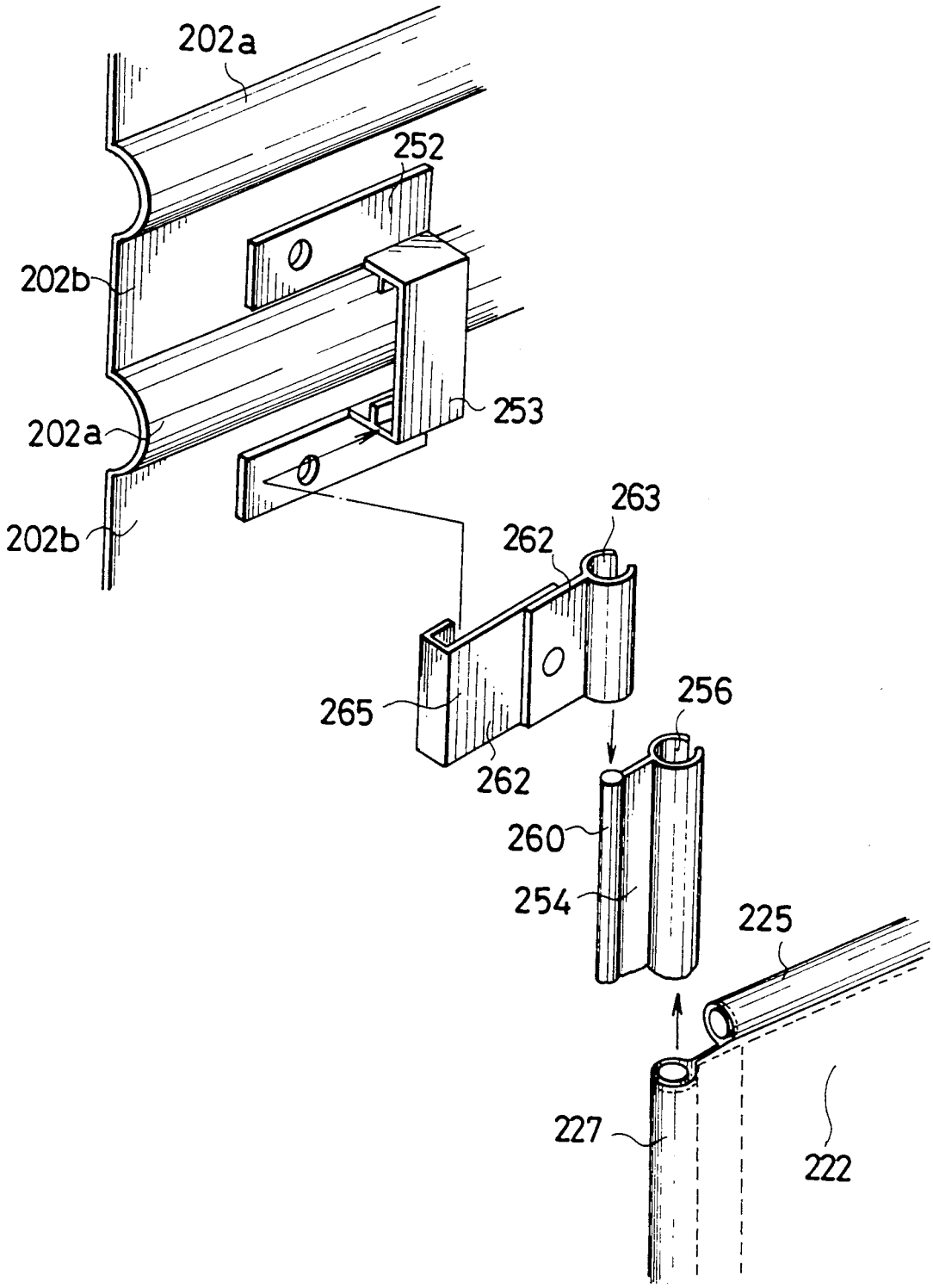
FIG. 27 is an explanatory view for explaining another state of assembling the advertising device in accordance with the present invention.

The sheet 211 composed of the upper sheet 222 and the lower sheet 223 is attached to the wall 202 of the truck 201 through the left side attaching means 251 in a manner as illustrated in FIGS. 20 and 27.

First, the edge 227 of the sheet 222 is inserted into the space 256 of the member 254. After that, the edge 260 of the member 254 is inserted into the space 263 of the hook 262. After that, the hook piece 265 of the hook 262 is engaged with the mouth 253 of the support member 252 so that the sheet 222 is attached to the wall 202. The lower sheet 223 is attached to the wall 202 substantially in the same way as the upper sheet 222 mentioned above.

It is to be noted that one integral continuous support bar member may be provided instead of the plurality of individual support members 252 as illustrated in FIG. 19.

The lower adjuster member 271 comprises a support member 272 which is secured to the wall 202 of the truck 201 and a plurality of hook members 274 having an adjuster 281.

The support member 272 comprises a support piece 273 which opens downward in FIG. 21.

Also, the hook members 274 are connected to an attachment member 277 which comprises a sleeve having a slit 276 on the upper side thereof the width of which corresponds to the thickness of the sheet 223. The sleeve has an inner space 275 into whice the thickened edge 230 of the sheet 223 is inserted. Also, the attachment member 277 has a plurality of slits 278 for hanging the hook members 274, as illustrated in FIGS. 19 and 22.

The hook member 274 comprises a hook piece 279, a belt 280 and an adjuster 281 for adjusting the length of the belt 280. An upper end of the belt 280 engages the slit 278 of the member 277. The piece 279 is secured to the lower end of the belt 280. The adjuster 281 is arranged in the middle portion of the belt 280.

In accordance with the structure of the adjuster means 271 mentioned above, as illustrated in FIG. 21, the lower sheet 223 is secured to the wall in such a way that, first, the edge 230 of the sheet 223 is inserted into the space 275 of the hook member 274, then the lower piece 279 of the belt 280 is hooked to the piece 273 of the lower support member 272. After that, the tension of the sheet 211 is adjusted by manipulating the adjuster 281 to adjust the length of the belt 280.

It is to be noted that each of the members 272 and 277 may be composed of a plurality of segments disposed in a line to substantially form a continuous structure instead of being formed from one integral longitudinal member as in the case of the above-mentioned embodiment.

The belt 280 is preferably made from a strong cloth such as a nylon cloth.

The right side adjuster means 291 comprises a plurality of support members 292 which are secured to the wall 202 of the truck 201 and hook members 294 and 102. The member 294 has an adjuster 102 in the middle portion thereof. Also, similarly, the member 102 has an adjuster 109.

Each member 292 has a mouth 293 which opens rightward in FIG. 20.

Each of the upper hook members 294 is connected to an attaching piece 297 which has a sleeve having a slit 296 on the left thereof and an inner space 295 for receiving the thickened edge 228 of the sheet 222. The width of the slit 296 corresponds to the thickness of the sheet 222. The structure of the lower hook member 102 is substantially the same as that of the member 294 mentioned above and similarly connected to an attaching piece 105 which has a sleeve having a slit 104 and an inner space 103 for receiving the edge 232 of the sheet 223.

The pieces 297 and 105 has a predetermined number of slits 298 and 106 corresponding to the hook members 294 and 102, respectively.

Each of the hook members 294 comprises a hook piece 299 to be hooked to the mouth 293 of the member 292, a belt 100 and an adjuster 101 for addjusting the length of the belt 100. An end of the belt 100 is connected to the piece 297 through the slit 298. To the other end of the belt 100, the hook piece 299 is secured. The adjuster 101 is arranged in the middle portion of the belt 100.

Each of the lower hook members 102 has substantially the same structure as the member 294 mentioned above. That is, the member 102 comprises a hook piece 107, a belt 108 and an adjuster 109. An end of the belt 108 engages the slit 106. The piece 107 is secured to the other end of the belt 108.

In accordance with the structure of the adjuster means 291 mentioned above, as illustrated in FIGS. 19, 20 and 22, the upper and the lower sheets 222 and 223 are secured to the wall in such a way that, first, the edge 228 (232) of the sheet 222 (223) is inserted into the space 295 (103) of the hook member 294 (102), then the right piece 299 (107) of the belt 100 (108) is hooked to the mouth 293 of the right side support member 292. After that, the tension of the sheet 222 (223) is adjusted by manipulating the adjuster 101 (109) to adjust the length of the belt 100 (108).

It is to be noted that one integral longitudinal member may be provided as the support means instead of the provision of the plurality of members 292 as mentioned above, as the structure of the support member 242 mentioned before. Also, the hook members 294 and 102 may be constituted from one integral member instead of being constituted from a plurality of members as mentioned above.

The belts 100 and 108 are preferably made from a strong cloth such as a nylon cloth.

The above-mentioned device 3 in accordance with the embodiment of the present invention is attached to the wall 202 of the truck 201 by a process described below.

As partly illustrated in FIGS. 18 and 22, on the wall 202 of the truck 201 are secured the upper member 242 of the means 241, the left side member 252 of the means 251, the lower member 272 of the means 271 and the right side member 292 of the means 291 at the predetermined position by an appropriate method such as welding or rivetting.

Figure 26:
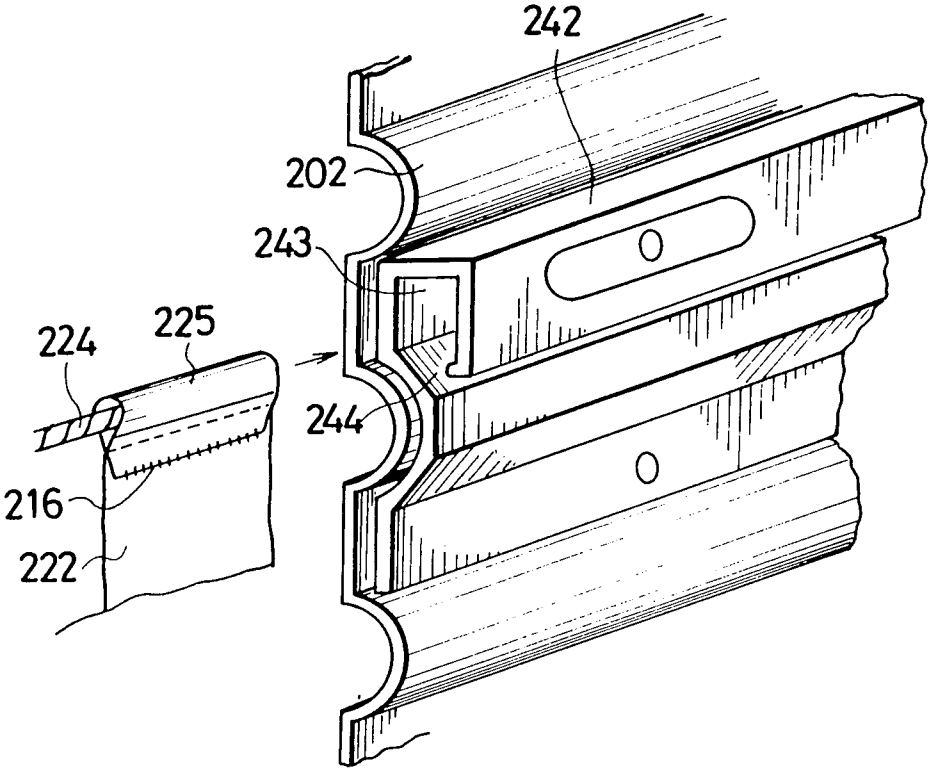
FIG. 26 is an explanatory view for explaining a state of assembling the advertising. device in accordance with the present invention.

First, the edge 225 of the upper sheet 222 of the sheet member 211 is inserted into the space 243 of the member 242, as illustrated in FIG. 26. Also, as illustrated in FIG. 27, the edge 227 of the upper sheet 222 is inserted into the space 256 of the member 254 as well as the edge 231 of the lower sheet 223 is inserted into the space 257 of the member 255. After that, the left edges 260 and 261 of the members 254 and 255 are inserted into the spaces 263 and 267 of the members 262 and 266, respectively. Also, the pieces 265 and 269 of the members 262 and 266 are hooked to the mouths 253 of the left members 252. In accordance with such a process, the upper portion and the left portion of the sheet member 211 are reliably attached to the wall 202.

After that, the edge 230 of the lower sheet 223 is inserted into the space 275 of the member 274. Also, the piece 279 of the belt 280 is hooked to the piece 273 of the lower member 272.

Also, the edges 228 and 232 of the sheets 222 and 223 are inserted into the spaces 295 and 103 of the members 294 and 102, respectively. After that, the pieces 299 and 107 of the belts 100 and 108 are hooked to the mouths 293 of the right members 292.

By this operation of process, the lower portion and the right portion of the sheet member 211 are reliably attached to the wall as well as the above-mentioned upper and the left portions of the sheet member 211. Also, at the same time, it is possible to adjust the tension of the sheet 211 in the state of being attached to the wall by manipulating the adjusters 101 and 109 to adjust the length of each of the belts 100 and 108.

After that, the zipper elements 217 and the fastening elements 219 of FIG. 23 are connected to corresponding elements 216 and 218 of the sheet 211 to cooperate with each other to reliably and easily fasten the poster 204 to the sheet 211.

As mentioned above, the poster 204 can be easily attached to the sheet 211 with certainty. Also, by the reverse sequence of the process mentioned above, the poster 204 can be easily detached from the sheet 211.

Figure 24:
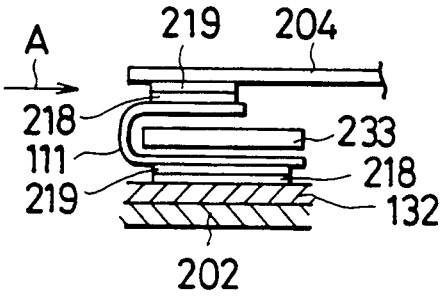
FIG. 24 is a partial sectional view of an essential part of an example of the advertising device in accordance with the present invention.
Figure 25:
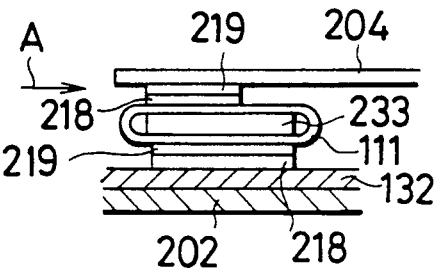
FIG. 25 is a partial sectional view of an essential part of another example of the advertising device in accordance with the present invention.

FIGS. 24 and 25 illustrate different structures, respectively, for preventing the draft from passing through an opening formed between the poster 204 and the wall 202 due to the lack of the fastening element 218 at the position of the members 233 which interconnect the upper and the lower sheets 222 and 223.

Figure 28:
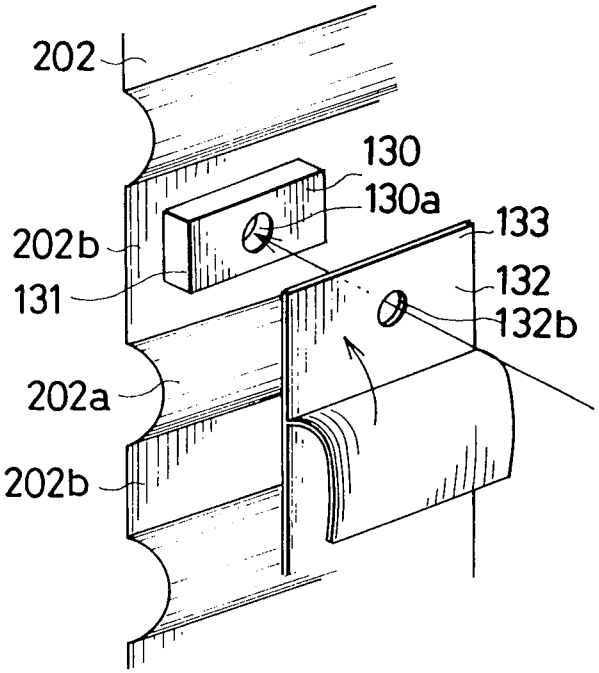
FIG. 28 is an explanatory view for explaining still another state of assembling the advertising device in accordance with the present invention.

In accordance with the structure of FIG. 24, a block 130 (FIG. 28) is disposed in a groove 202*b* between the ribs 202*a* and 202*a* of the wall 202 at the position under the expansion members 233 at each of the right end and the left end of the sheet 211. The height of the block 130 is substantially equal to that of the rib 202*a*. A strip shaped plate 132 is disposed on the block 130 and the ribs 202*a* along the member 233. The plate 132 is secured to the wall 202 along with the block 130 by means of, for example, rivet struck through a hole 130*a* of the block 130 and a hole 132*b* of the plate 132. A fastening element 218 is preattached on the front surface 133 of the plate 132. A flexible blind member 111 is arranged to enclose the member 133 from the lateral outside thereof and secured to the upper poster 204 and the lower plate 132, respectively, through the fastening elements 218 and 219 attached to the corresponding positions on the blind member side and the poster and the plate side.

FIG. 25 illustrates another structure for blinding the opening between the poster 204 and the wall 202 at the position of member 233 disposed between the upper sheet 222 and the lower sheet 223. In this structure, the blind member 111 entirely encloses the member 233 without obstructing the expansion motion of the member 233.

By the provision of such a blind member 111 disposed at each side of the poster 204, the poster 204 is further firmly secured to the sheet 211 and the draft indicated by an arrow A (FIGS. 24 and 25) can be reliably prevented.

It is to be noted that the opening may be choked by a caulking compound.

In accordance with the device 3 mentioned above, the upper and the lower sheets 222 and 223 are interconnected by members 233 in such a way that the lower edge 226 of the upper sheet 222 is thickened by the rope 224 and inserted into the space 234*a* of the member 234 secured to the members 233 and that the upper edge 229 of the lower sheet 223 is thickened by the rope 224 and inserted into the space 235*a* of the member 235 secured to the members 233 so that the members 233 are detachably connected to the sheets 222 and 223, respectively.

Instead of the structure mentioned above, FIG. 29 illustrates a variant of the structure of the member 233 wherein the edge 226 of the upper sheet 222 and the edge 229 of the lower sheet 223 are directly connected to the upper and the lower end of the members 233, respectively.

Figure 30:
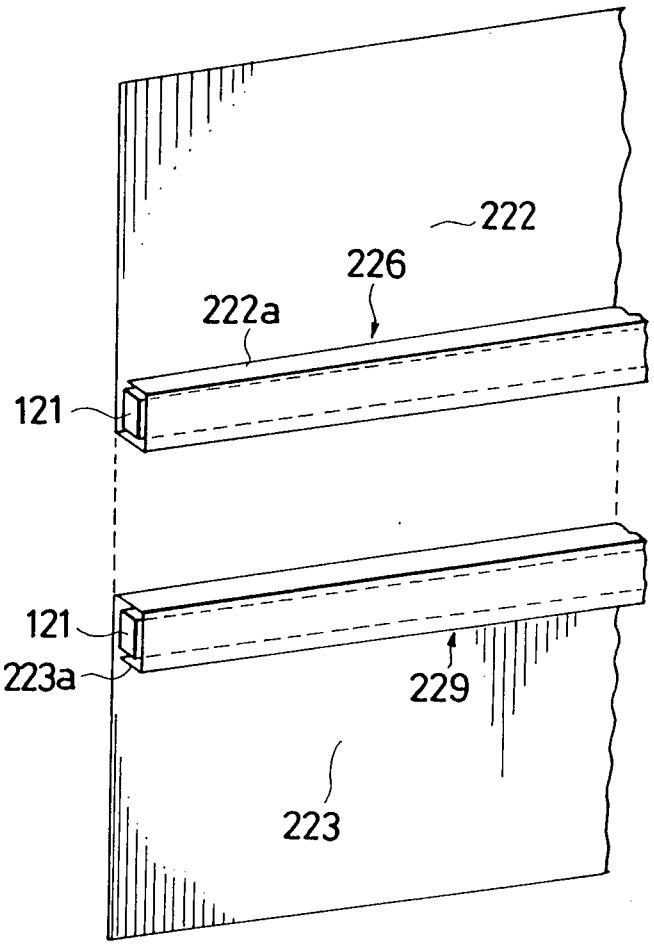
FIG. 30 is a partial perspective view of a still further embodiment of the advertising device in accordance with the present invention.
Figure 31:
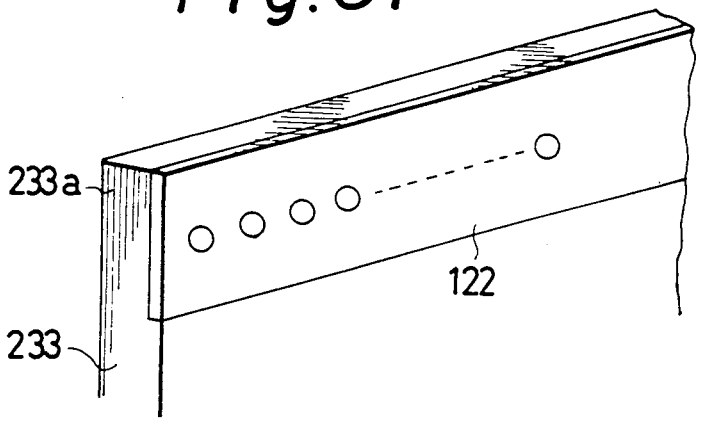
FIG. 31 is a partial perspective view of a still further embodiment of the advertising device in accordance with the present invention.

More precisely, as illustrated in FIG. 30, the sheet end 222*a* of the sheet 222 is wound to enclose a core member 121 therein. Similarly, the sheet end 223*a* of the sheet 223 is wound to enclose a core member 121 therein. Also, as illustrated in FIG. 31, a pressing plate 122 is secured to an end 233*a* of the member 233. The plate 122 is arranged at the portion of the sheet ends 222*a* and 223*a* in such a way that the member 233 is sandwiched by the plate 122 and each of the sheet ends 222*a* and 223*a* at the upper and the lower end of the member 233 and that the sandwich structure is fixed by means of rivets 123.

Figure 29:
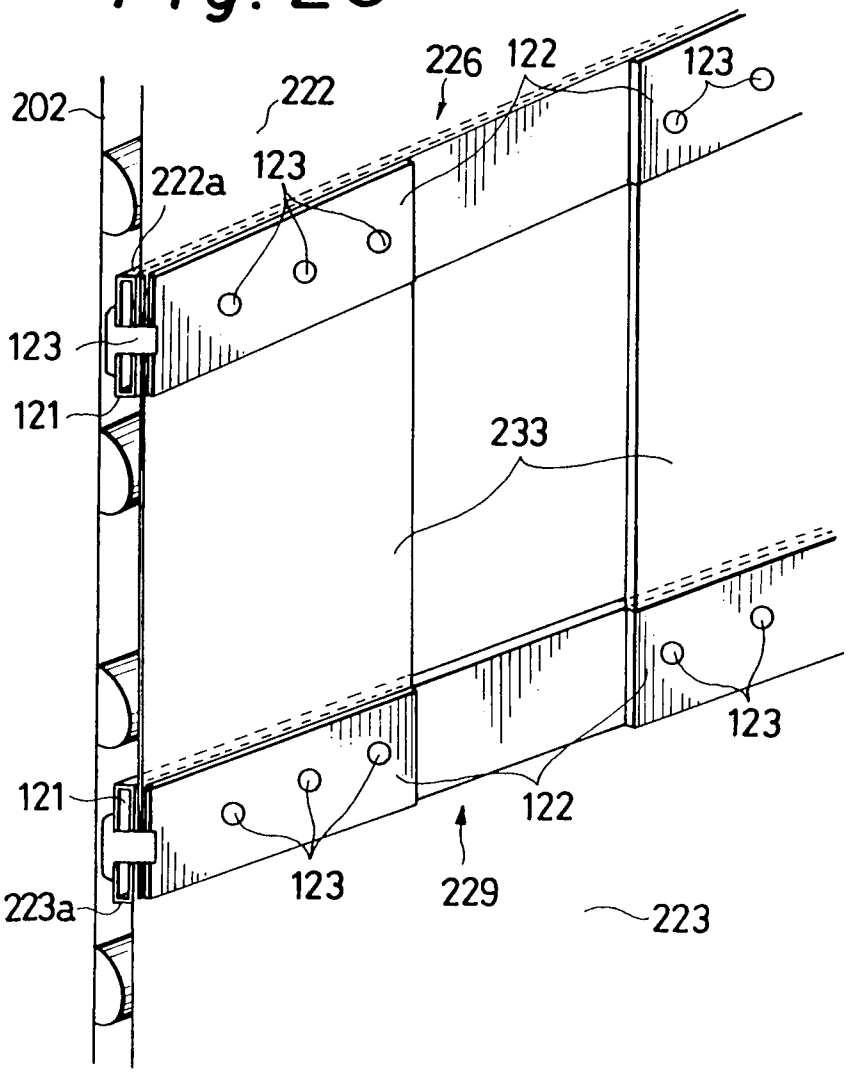
FIG. 29 is a partial perspective view of a further embodiment of the advertising device in accordance with the present invention.

In accordance with the structure of FIGS. 29 to 31, mentioned above, it becomes possible to obtain a thin device 3 in addition to that the device 3 functions substantially in the same manner as the preceding embodiment and has substantially the same advantages as the preceding embodiment.

It is desirable to dispose a strengthening patch cloth at each edge of the core member 121 to prevent the sheet edge from being torn by the edge.

The core member 121 is preferably made from aluminium and the plate 122 is preferably made from stainless steel.

Two plates 122 may be bonded on both sides of the member 233 at each end thereof instead of the arrangement of FIG. 31 wherein only one plate 122 is bonded on one of the sides of the member 233.

As can be seen from the embodiments mentioned above, it is possible to modify the structure in various ways to obtain a wide variety of variants of the embodiments.

Figure 32:
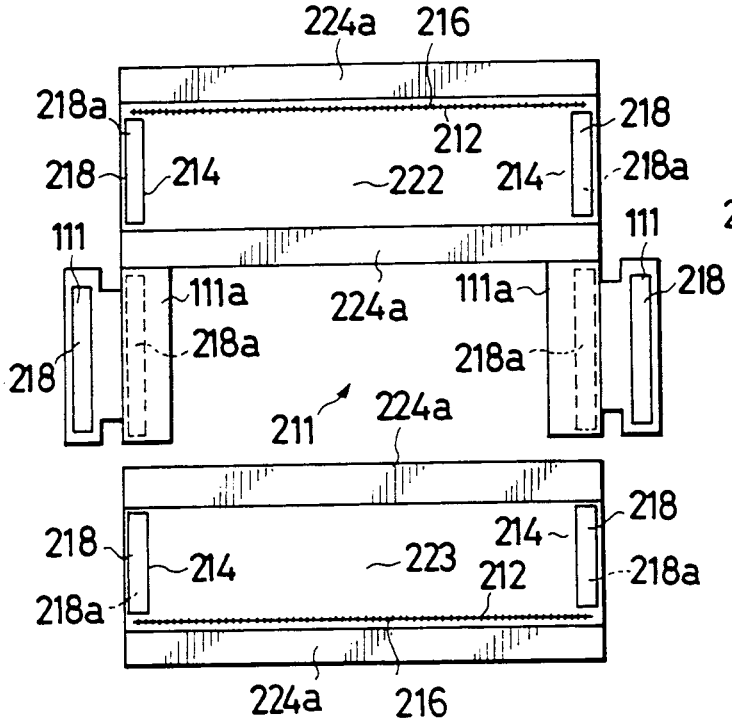
FIG. 32 is an explanatory view of an example of the sheet member of the advertising device in accordance with the present invention.

FIG. 32 illustrates another example of the sheet 211. This example comprises an upper sheet 222 and a lower sheet 223 as the preceding embodiments. However, the left side means 254 and 255 and the right side means 291 and 102 of the preceding embodiments are deleted from this structure of FIG. 32. Instead, this structure is provided with a magic fastener element 218*a* in the back side of the upper sheet 222 at each lateral end 214 thereof in addition to the element 218 in the front side of the sheet 222 at the same position thereof. The back side elements 218*a* are arranged to attach the sheet 222 to the wall 202 of the truck 201. The lower sheet 223 has the same structure as the upper sheet 222.

The sheets 222 and 223 have margins 224*a* for enclosing the rope 224 at the upper and the lower ends thereof, respectively.

Also, at each of the right and the left ends of the margin 224*a* of the sheet 222 is connected a member 111*a* for supporting the abovementioned blind member 111. The member 111*a* has a magic fastener element 218*a* attached thereto to cooperate with the element 218 of the blind member 111.

Figure 33:
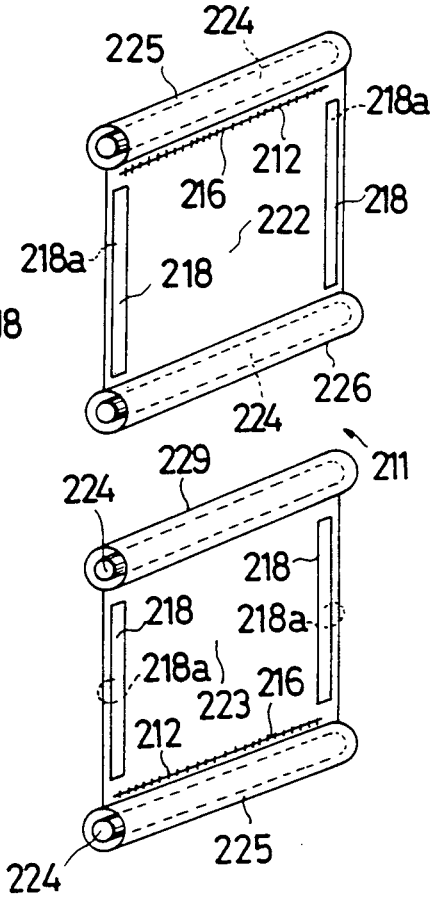
FIG. 33 is an explanatory view of another example of the sheet member of the advertising device in accordance with the present invention.

FIG. 33 illustrates the sheet 211 of FIG. 32 in a state of a middle stage of being assembled.

Figure 34:
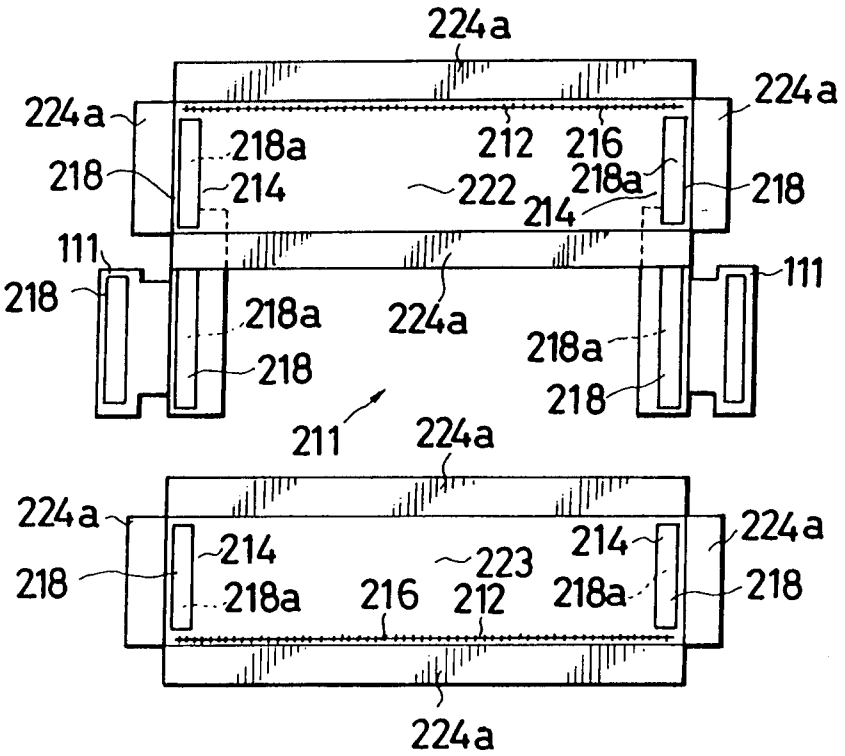
FIG. 34 is an explanatory view of still another example of the sheet member of the advertising device in accordance with the present invention.

The sheet structure of FIG. 32 can be applied to the sheet 211 of FIG. 19, as illustrated in FIG. 34.

Figure 35:
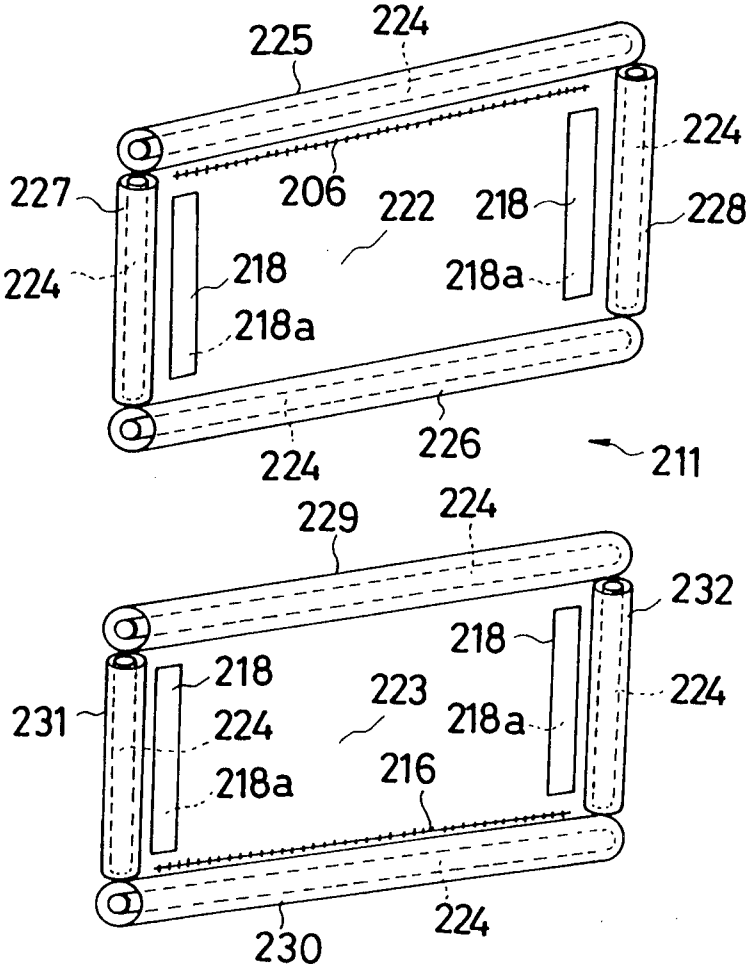
FIG. 35 is an explanatory view of a further example of the sheet member of the advertising device in accordance with the present invention.

FIG. 35 illustrates the sheet 211 of FIG. 34 in a state of a middle stage of being assembled.

In the embodiments mentioned above, the sheet 211 is attached to the wall 202 of the truck 201 with the use of magic fastener elements 18 and 19 in cooperation with each other. In this case, it is necessary to form a flat surface on the wall 201 around the portion of the elements 218 and 219 which wall has ribs 202*a* at regular intervals, as illustrated in FIG. 27. For this purpose, the structure of FIG. 28 can be adopted. That is, a block 130 having a thickness 131 which corresponds to the height of the rib 202*a* is disposed in each groove 202*b* between the adjacent two ribs 202*a*. A strip shaped plate member 132 is disposed on the block 130 and secured to the wall 202 along with the block 130 by means of rivets 123. Through holes 130*a* and 132*b* are formed in the block 130 and the plate 132, respectively, for passing the rivet therethrough.

Of course, it is possible to use screws instead of rivets 123.

Also, it is necessary to provide at least two plates 132 on the wall 202 through the blocks 130. The number of the plates 132 and the position where the plates are disposed are determined in accordance with the size of the advertising device 3 to be attached.

In accordance with the arrangement mentioned above, it becomes easy to bond the element 218 or 219 on the front surface of the plate 132.

The plate 132 is preferably made from aluminium.

FIGS. 36 to 41 illustrate enlarged perspective views of members used to constitute the advertising device in accordance with the present invention.

Figure 36:
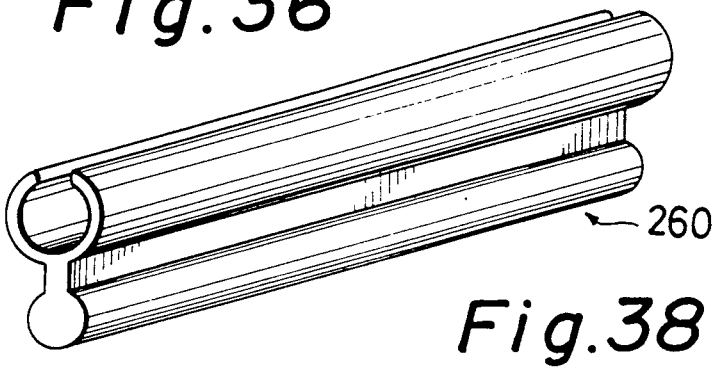
FIG. 36 is a perspective view of an example of an essential member of the advertising device in accordance with the present invention.
Figure 37:
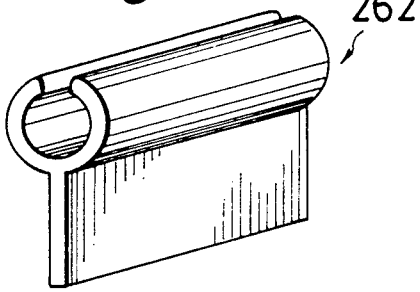
FIG. 37 is a perspective view of another example of the essential member of the advertising device in accordance with the present invention.
Figure 38:
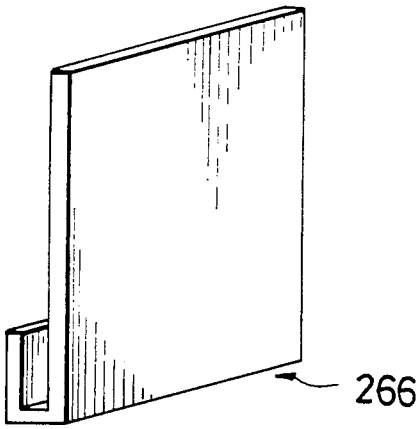
FIG. 38 is a perspective view of still another example of the essential member of the advertising device in accordance with the present invention.
Figure 39:
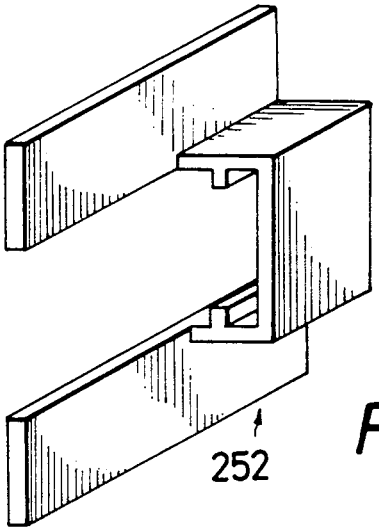
FIG. 39 is a perspective view of a further example of the essential member of the advertising device in accordance with the present invention.
Figure 40:
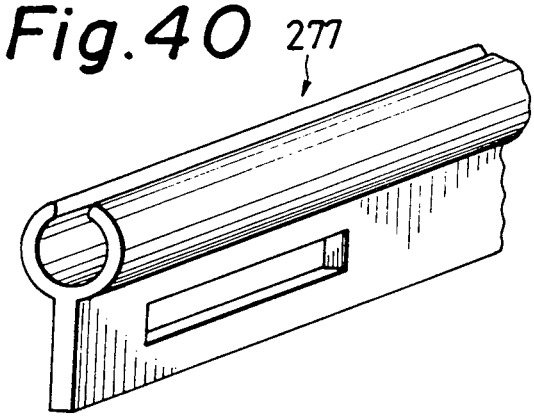
FIG. 40 is a perspective view of a still further example of the essential member of the advertising device in accordance with the present invention.
Figure 41:
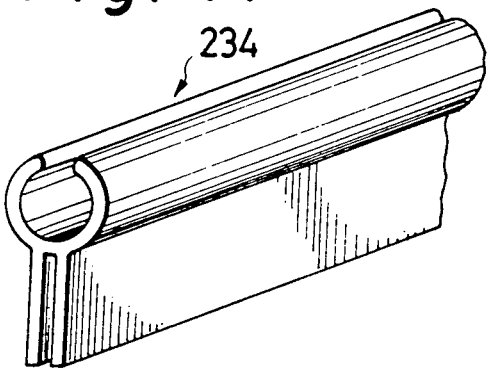
FIG. 41 is a perspective view of a still further example of the essential member of the advertising device in accordance with the present invention.

Namely, the thickened edge 260 of the attachment member 254 (FIGS. 22 and 27) is illustrated in FIG. 36. The hook member 262 is illustrated in FIG. 37. The hook piece of the hook member 266 is illustrated in FIG. 38. The support member 252 is illustrated in FIG. 39. The attachment member 277 is illustrated in FIG. 40. And the holder member 234 is illustrated in FIG. 41.

Figure 42:
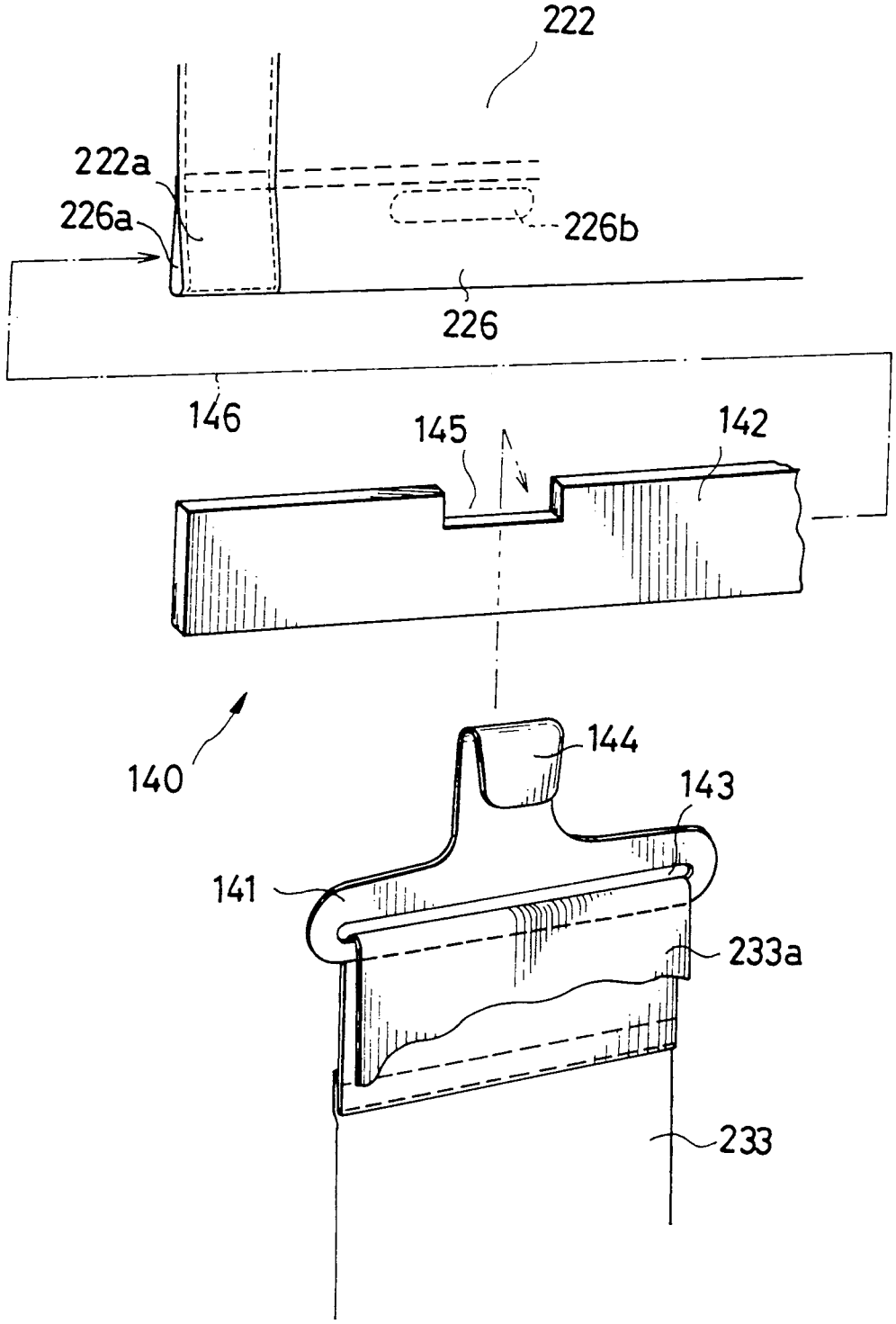
FIG. 42 is a partial perspective view of a further embodiment of the advertising device in accordance with the present invention.

Moreover, in advertising device 3 of the present invention, another connecting means 140 as shown in FIG. 42 can be used in place of the connecting means for connecting the above-mentioned expansion member 233, upper sheet 222 and lower sheet 223 respectively, as shown in each of FIGS. 29–31.

Incidentally, FIG. 42 shows only upper sheet 222, omitting lower sheet 223, because upper and lower sheets 222 and 223 have the same construction and are attached in the same manner.

Connecting means 140 as shown in FIG. 42 comprises hook member 141 and core member 142 made from metal, adapted to be hooked by this hook member 141.

Hook member 141 is provided with through slit 143 permitting insertion of expansion member 233 by end 233*a* thereof and with curved portion 144 to hook core member 142.

Expansion member 233 is inserted by end 233*a* into through slit 143 to be folded into folds one on another fixed to each other by appropriate means such as adhesion, stitching, welding, etc.

Core member 142 is provided with concave portion 145 for permitting curved portion 144 to hook core member 142 easily and securely.

Upper sheet 222 is previously folded by lower end 222*a* into folds one on another, followed by fixing them to each other by appropriate means such as adhesion, stitching, etc., samely as the above expansion member 233 inserted by end 233*a* into through slit 143, to form lower thickened edge 226, resulting in space 226*a* contained in lower thickened edge 226. On the other hand, lower thickened edge 226 is provided with through hole 226*b*, to be mentioned later, formed thereon to permit insertion of curved portion 144 of hook member 141, in connecting expansion member 233, upper sheet 222 and lower sheet 223 respectively.

Connecting means 140 of the above construction is attached in the following steps:

To begin with, core member 142 is inserted into space 226*a* formed inside lower thickened edge 226, in the direction along lower thickened edge 226 as shown with arrow 146 in FIG. 42;

Core member 142 is positioned so as to bring concave portion 145 of the same core member 142 into coincidence with through hole 226*b* of lower thickened edge 226;

Then, hook member 141 is inserted by curved portion 144 into through hole 226*b* of lower thickened edge 226 to hook core member 142 on concave portion 145. In this situation, curved portion 144 of hook member 141 is fitted in concave portion 145 of core member 142 to be prevented from any movement in the above mentioned direction of arrow 146 and also from disengagement from concave portion 145 of core member 142 due to the tensile force of expansion member 233 inserted into through hole 143 of hook member 141.

Many widely different embodiments of the present invention may be constructed without departing from the spirit and scope of the present invention. It should be understood that the present invention is not limited to the specific embodiments described in the specification, except as defined in the appended claims.

What is claimed is:

1. An advertising device comprising:

a flexible sheet-like advertising bill having at least two edges spaced one from the other;

a flexible sheet-like member on which said advertising bill is disposed;

a pair of fasteners for detachably fastening said advertising bill and said sheet-like member one to the other, whereby said advertising bill overlays said sheet-like member, said fasteners comprising first fastening elements disposed along said two edges of said bill and second fastening elements provided on said sheet-like member for cooperation with said first fastening elements;

an expansible means provided on said sheet-like member for adding elasticity to said sheet-like member;

said second fastening elements being spaced one from the other along said sheet-like member in registration with said two edges, respectively, of said advertising bill and said first fastening elements thereof, said expansible means being disposed between said second fastening elements and said opposed two edges; and wherein said sheet-like member comprises a pair of sheet member portions spaced one from the other, said expansible means including an elastic member disposed on an intermediate portion of said sheet-like member and connecting said sheet member portions one to the other.

2. An advertising device according to claim 1, including a base structure and adjusting means connected between said base structure and said sheet-like member for adjusting the tension of said sheet-like member.

3. An advertising device according to claim 2, wherein said adjusting means comprises a belt which interconnects said sheet-like member and said base structure, the length of said belt being adjustable so that said tension of said sheet-like member can be adjusted.

4. An advertising device according to claim 1, further comprising a base structure, connecting means for connecting a peripheral edge of said sheet-like member and said base structure and adjusting means for adjusting the tension of said sheet-like member.

* * * * *

UNITED STATES PATENT AND TRADEMARK OFFICE

CERTIFICATE OF CORRECTION

PATENT NO. : 5,058,299

DATED : October 22, 1991

INVENTOR(S) : SUZUKI

It is certified that error appears in the above-identified patent and that said Letters Patent is hereby corrected as shown below:

Title page, column 1, item [30] should read as follows:

-- Feb. 7, 1989 [JP] Japan 1-13271 [U]
Oct. 25, 1989 [JP] Japan 1-278290
Dec. 26, 1989 [JP] Japan 1-337497 --

Signed and Sealed this

First Day of November, 1994

*Attest:*

*Attesting Officer*

BRUCE LEHMAN

*Commissioner of Patents and Trademarks*